US009126410B2

(12) United States Patent
Hagiwara et al.

(10) Patent No.: US 9,126,410 B2
(45) Date of Patent: Sep. 8, 2015

(54) LIQUID EJECTING HEAD UNIT AND LIQUID EJECTING APPARATUS

(71) Applicant: Seiko Epson Corporation, Tokyo (JP)

(72) Inventors: Hiroyuki Hagiwara, Matsumoto (JP); Akihisa Wanibe, Matsumoto (JP); Kazutoshi Shimizu, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/225,295

(22) Filed: Mar. 25, 2014

(65) Prior Publication Data

US 2014/0292905 A1 Oct. 2, 2014

(30) Foreign Application Priority Data

Mar. 28, 2013 (JP) ..... 2013-070723

(51) Int. Cl.
*B41J 2/165* (2006.01)
*B41J 2/155* (2006.01)
*B41J 2/14* (2006.01)

(52) U.S. Cl.
CPC ..... *B41J 2/155* (2013.01); *B41J 2002/14491* (2013.01); *B41J 2202/18* (2013.01)

(58) Field of Classification Search
USPC ..... 347/22
See application file for complete search history.

(56) References Cited

U.S. PATENT DOCUMENTS

| | | | | |
|---|---|---|---|---|
| 4,343,013 | A * | 8/1982 | Bader et al. | 347/47 |
| 2006/0033773 | A1* | 2/2006 | Owaki | 347/45 |
| 2007/0182788 | A1 | 8/2007 | Tanuma | |
| 2008/0062218 | A1* | 3/2008 | Yanagisawa et al. | 347/19 |
| 2012/0229561 | A1* | 9/2012 | Ishii et al. | 347/29 |

FOREIGN PATENT DOCUMENTS

JP 2011-046144 A 3/2011

* cited by examiner

*Primary Examiner* — Stephen Meier
*Assistant Examiner* — Alexander D Shenderov
(74) *Attorney, Agent, or Firm* — Kilpatrick Townsend & Stockton LLP

(57) ABSTRACT

A liquid ejecting head unit includes a plurality of heads having a nozzle surface in which nozzle openings that eject ink are provided; a cover head that protects the nozzle surfaces of the heads, and a cover that covers the heads and between the nozzle surfaces of each head, in which the cover has a conducting portion that conducts with the cover head of the head.

10 Claims, 25 Drawing Sheets

LIQUID EJECTING HEAD UNIT AND LIQUID EJECTING APPARATUS

CROSS REFERENCES TO RELATED APPLICATIONS

This application claims priority to Japanese Patent Application No. 2013-070723 filed on Mar. 28, 2013, and Japanese Patent Application No. 2013-270546 filed on Dec. 26, 2013. The entire disclosure of Japanese Patent Application Nos. 2013-070723 and 2013-270546 are hereby incorporated herein by reference.

BACKGROUND

1. Technical Field

The present invention relates to a liquid ejecting head unit and a liquid ejecting apparatus, and, in particular, relates to an ink jet recording head unit and an ink jet recording apparatus that eject ink as a liquid.

2. Related Art

A liquid ejecting apparatus represented by an ink jet recording apparatus, such as an ink jet printer or plotter, includes a liquid ejecting head (below, referred to simply as a head) that ejects a liquid, such as ink, stored in a cartridge or a tank.

Lining up a plurality of nozzle openings in a single head and lengthening (increasing the number of nozzles) or increasing the density thereof is difficult. Therefore, a liquid ejecting head unit (hereinafter, simply referred to as a head unit) including a plurality of heads has been proposed (for example, refer to JP-A-2011-46144).

In the head unit, the metal components that configure the head may be charged due to static electricity from the recording medium such as a recording paper or from the outside, and thus there is concern of a piezoelectric element for providing pressure to the ink or a driver IC for driving the piezoelectric element being damaged.

Therefore, charging in the head is suppressed by electrically connecting each head to the carriage or the like of the ink jet recording apparatus.

However, because providing a conducting portion by which each head is grounded on the carriage is necessary, the space in which the conducting portion is arranged is necessary. Furthermore, the number of components necessary for the conducting portion increases according to the number of heads, and the cost increases.

Such problems arise not only in a head unit that includes an ink jet recording head that ejects ink, but similarly arise in liquid ejecting head units and liquid ejecting apparatuses that include a liquid ejecting head that ejects a liquid other than ink.

SUMMARY

An advantage of some aspects of the invention is to provide a liquid ejecting head unit and a liquid ejecting apparatus able to effectively prevent charging in the liquid ejecting head.

According to an aspect of the invention, there is provided a liquid ejecting head unit including a plurality of liquid ejecting heads including a liquid ejecting surface in which nozzle openings that eject a liquid are provided; a protective plate that protects the liquid ejecting surface of each liquid ejecting head, and a cover that covers between the liquid ejecting surfaces of each liquid ejecting head; in which the cover has a conducting portion that electrically conducts with the protective plate of the liquid ejecting head.

According to the aspect, by providing the conducting portion in the cover that protects the liquid ejecting head, the cover also serves a grounding function. In so doing, it is possible to achieve space savings and cost reductions by reducing the number of grounding members for grounding each liquid ejecting head. In this application, the term "ground" is not limited to connection to a grounding surface, but means setting to a predetermined reference potential.

It is preferable that the liquid ejecting head unit further include a holding member to which a plurality of the liquid ejecting heads is fixed and that, the liquid ejecting heads be grounded to the cover via the holding member. Thereby, even in a case in which conduction is not directly established between the liquid ejecting head and the cover, the liquid ejecting head and the cover can be grounded via the holding member.

It is preferable that the liquid ejecting head unit further include an elastic sealing member that seals between the protective plate and the cover; and a fixing member that fixes the cover and the holding member to be able to conduct with each other. Thereby, the transfer of foreign materials such as liquid from the exterior of the cover to the interior of the cover via a space between the protective plate and the cover can be suppressed, and damage due to shorting of electronic components of the liquid ejecting head can be suppressed.

It is preferable that the liquid ejecting head unit further include a plate spring-like grounding plate fixed to the holding member, and that the grounding plate contact the protective plate by being biased and conduct with the protective plate and the holding member. Thereby, the holding member and the protective plate can be made to conduct via the grounding plate. Since the grounding plate is formed in a plate spring shape, a state in which the grounding plate is in contact with the protective plate side is easily maintained, and the protective plate can more reliably conduct with holding member.

It is preferable that the cover include an outside member, a first groove forming member, and a second groove forming member between the outside member and the first groove forming member, a head opening by which the liquid ejecting surface of the liquid ejecting head is exposed be provided in the outside member, the first groove forming member and the second groove forming member, the outside member conduct with the first groove forming member, the fixing member fix the first groove forming member and the holding member to be able to conduct with each other, and the elastic sealing member be arranged at the groove portion in which the inner surface of the head opening is provided, and is interposed between the outside member and the first groove forming member. Thereby, the elastic sealing member can be easily fixed to the first groove forming member and the outside member.

It is preferable that the first groove forming member be formed to be thicker than the outside member and thinner than the second groove forming member, that the outside member and the first groove forming member each have a curved side surface portion, and that the second groove forming member be formed in a planar shape. Thereby, since the first groove forming member and the outside member are relatively thin, the members are easily formed curved. Because the thickest second groove forming member has a planar shape that is not bent, the width in the transport direction can be reduced.

It is preferable that the cover be attachable and detachable, and that the conducting portion abut on the protective plate by elastic deformation. Thereby, each liquid ejecting head can be set to a standard potential by simply attaching a cover.

It is preferable that a protrusion be provided at a position opposing a region abutted by the conducting portion of the protective plate on the liquid ejecting head or the protective plate. Thereby, contact between the conducting portion and the protective plate can be more reliably established.

According to another aspect of the invention, there is provided a liquid ejecting apparatus including a liquid ejecting head unit according to the above aspects.

According to the aspects, a liquid ejecting apparatus able to prevent charging in the liquid ejecting head, and able to save space and lower costs is provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Hereinafter, embodiments of the present invention are explained in detail based on drawings. The ink jet recording head unit is an example of a liquid ejecting head unit, and is simply referred to as a head unit. The ink jet recording head is one example of a liquid ejecting head, and is simply referred to as a head.

Figure 1:
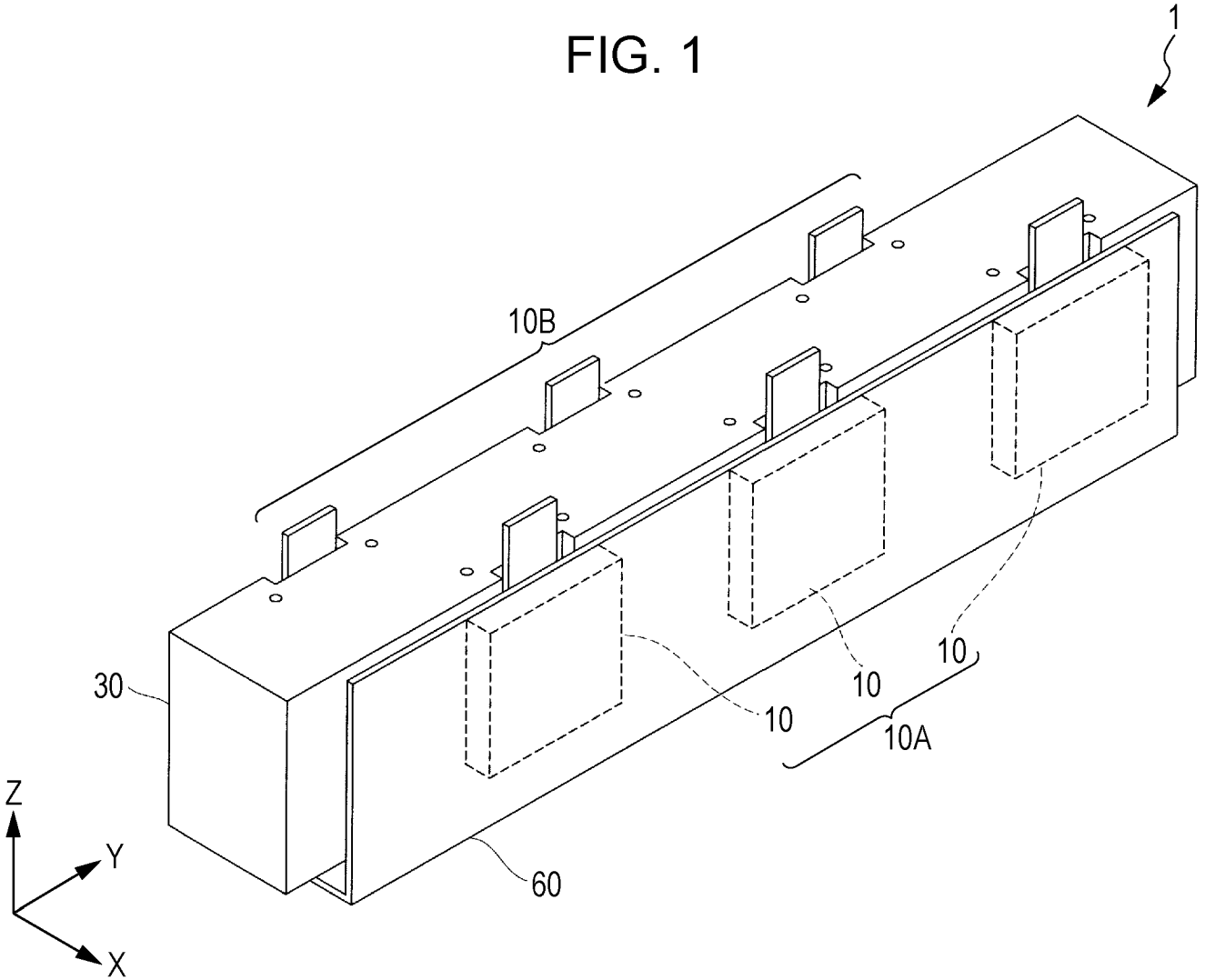
FIG. 1 is a schematic perspective view diagram of a head unit according to Embodiment 1.
Figure 2:
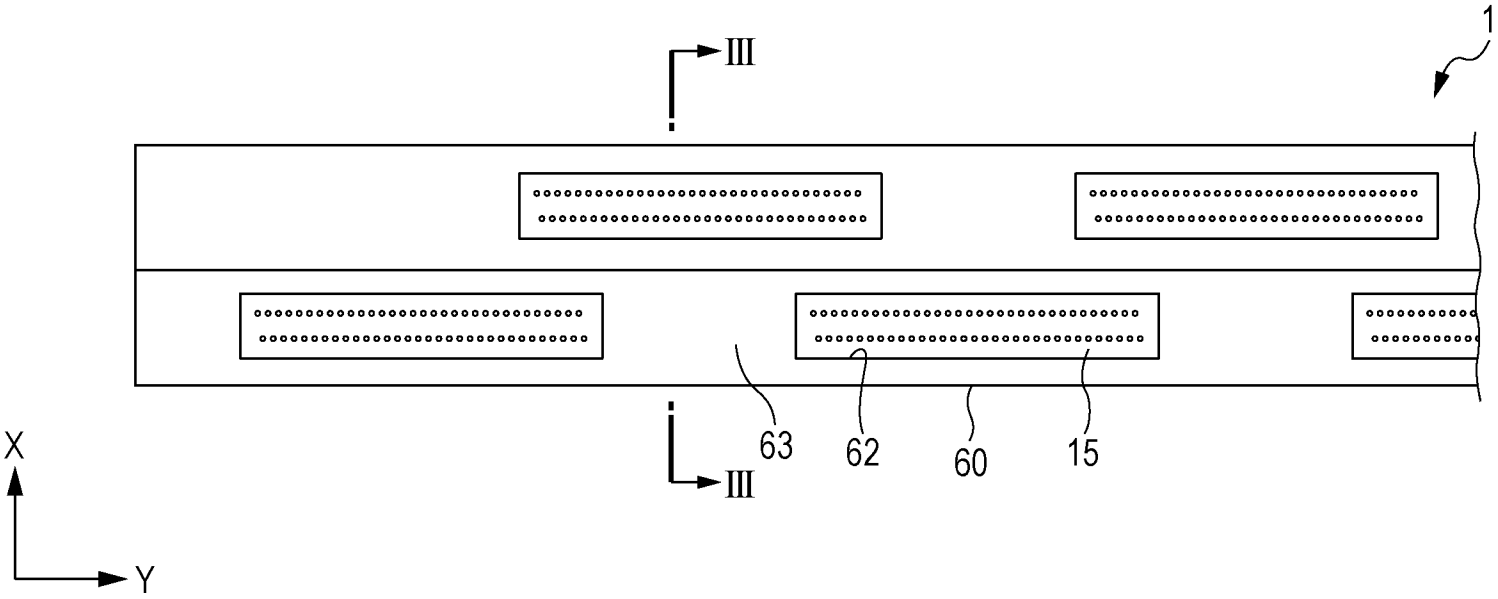
FIG. 2 is a bottom view of the head unit according to Embodiment 1.
Figure 3:
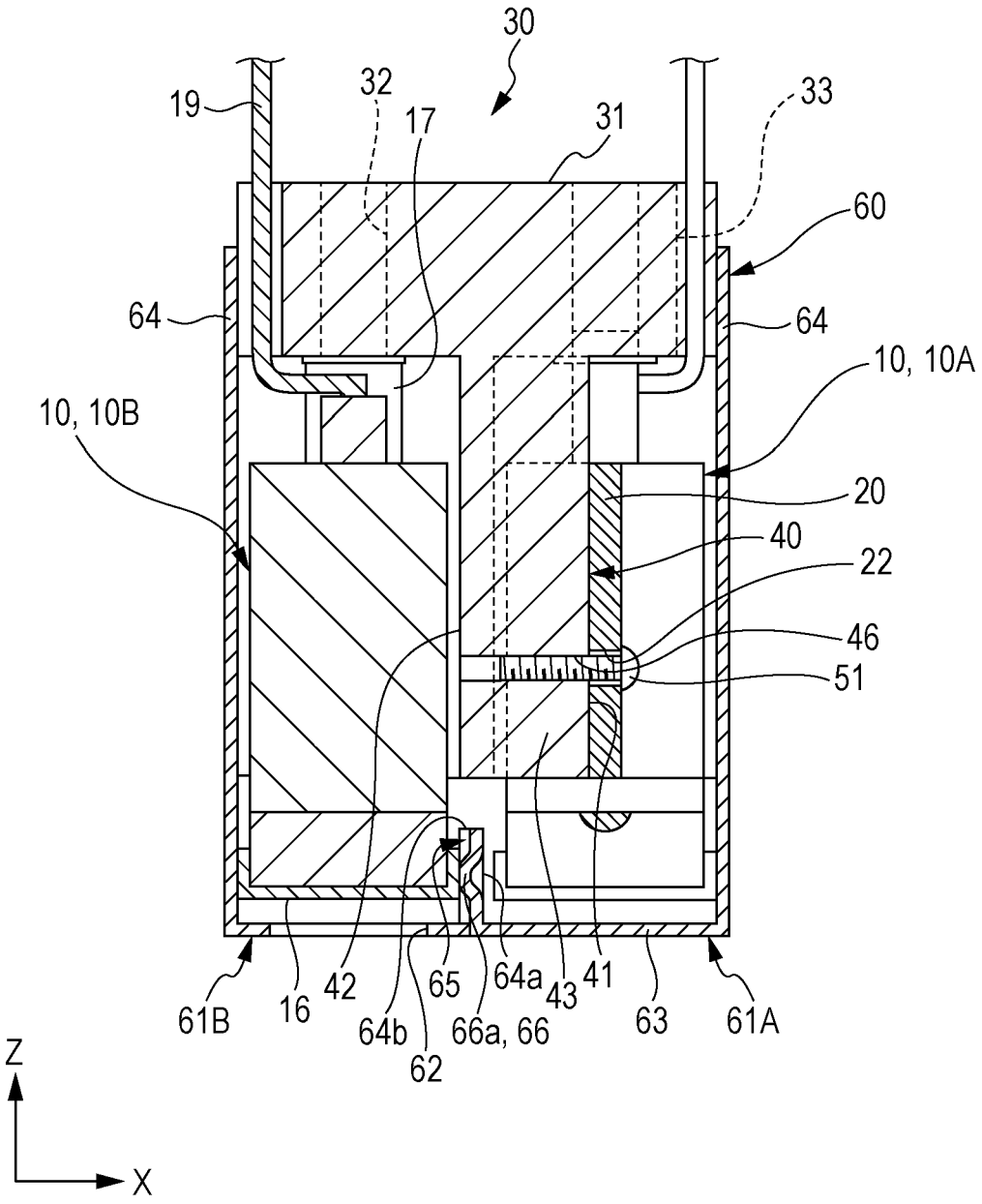
FIG. 3 is a cross-sectional view taken along the line III-III in FIG. 2.

FIG. 1 is a schematic perspective view of the head unit according to the present embodiment, FIG. 2 is a bottom view of a head unit according to the embodiment, and FIG. 3 is a cross-sectional view taken along line III-III in FIG. 2.

The head unit 1 includes a plurality of heads 10 fixed to a holding member 30, a cover head 16 that is an example of a protective plate that protects a nozzle surface 15 that is an example of a liquid ejecting surface of the head 10, and a cover 60 that covers between the head 10 and the nozzle surface 15 of each head 10.

The head unit 1 according to the embodiment has six heads 10 fixed to one holding member 30. Two rows of a head row 10A and a head row 10B in which three heads 10 are arranged in line in the Y direction are formed. The head row 10A and the head row 10B are arranged to oppose one another with the holding member 30 interposed, and the relative positions of between each head 10 are regulated and fixed to the holding member 30. In the embodiment, the nozzle surface 15 by which each head 10 discharges ink is set to the XY plane, and the direction in which the heads 10 are arranged in line is set to the Y direction. That is, the head row 10A and the head row 10B are formed of a plurality of heads 10 arranged in line in the Y direction. The head row 10A and the head row 10B are arranged in parallel in the X direction orthogonal to the Y direction. A direction orthogonal to the XY plane is set as the Z direction.

Figure 4:
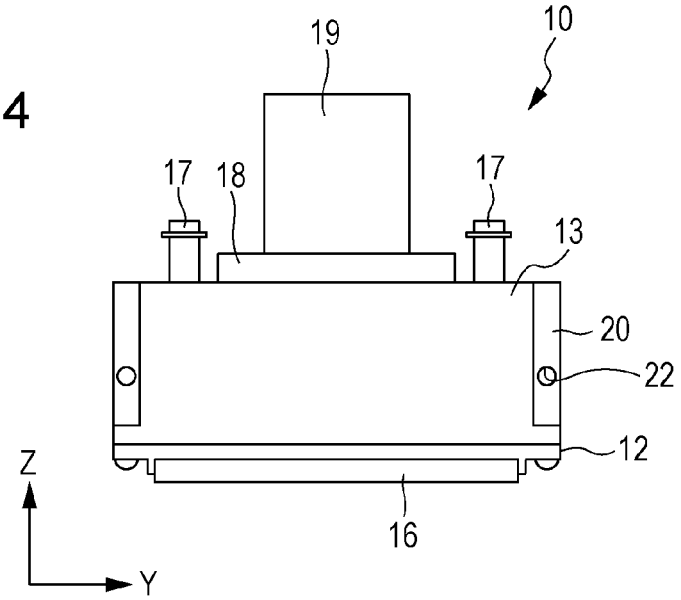
FIG. 4 is a front view of a head according to Embodiment 1.
Figure 5:
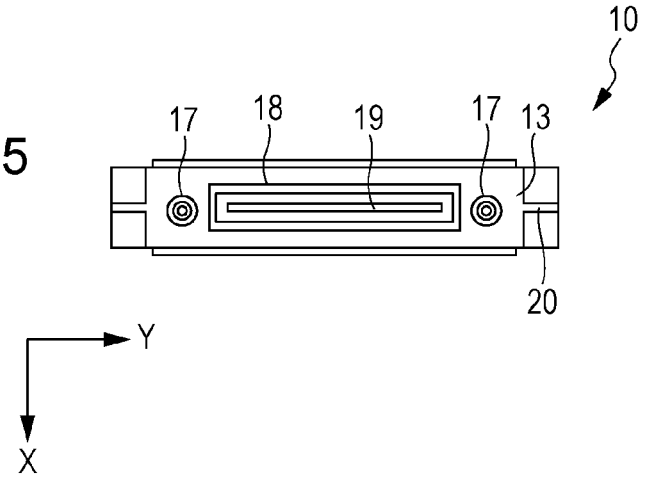
FIG. 5 is a top view of the head according to Embodiment 1.
Figure 6:
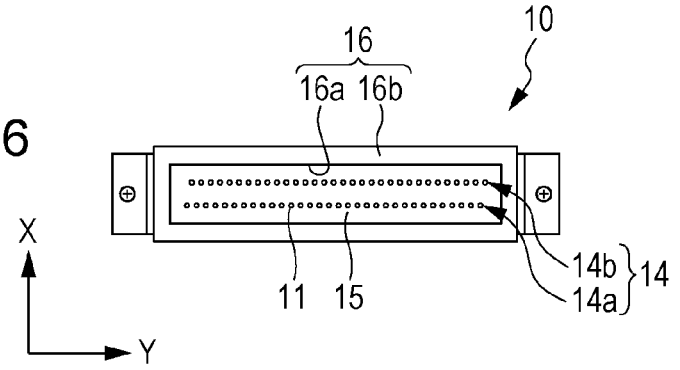
FIG. 6 is a bottom view of the head according to Embodiment 1.

The head 10 will be described in detail using FIGS. 4 to 6. FIG. 4 is a front view of the head, FIG. 5 is a top view of the head, and FIG. 6 is a bottom view of the head.

The head 10 includes a head main body 12 in which the nozzle openings 11 are provided, and a flow channel member 13 fixed to the surface of the head main body 12 on the opposite side to the nozzle openings 11.

The head main body 12 includes nozzle rows 14. The surface on which the nozzle rows 14 are provided is set as the nozzle surface 15 (liquid ejecting surface).

The nozzle row 14 refers to a plurality of nozzle openings 11 arranged in line in the Y direction (first direction). In the embodiment, nozzle row 14*a* and nozzle row 14*b* in which nozzle openings 11 are aligned linearly in the Y direction are arranged in two rows. The nozzle openings 11 of the one nozzle row 14*a* are formed shifted by a half pitch from the nozzle openings 11 of the other nozzle row 14*b*. Either of the nozzle rows 14*a* and 14*b* ejects the same type of liquid, and the two nozzle rows 14*a* and 14*b* substantially form one nozzle row 14. In the invention, the nozzle row 14 formed as substantially one row is referred to as a nozzle row. In so doing, the resolution may be doubled. The nozzle row may have a form in which three or more rows substantially configure one row. Naturally, only one nozzle row may also be included. Two or more nozzle rows may be included, and each nozzle row may eject different types of liquid, and in this case, a plurality of nozzle rows are included.

The cover head 16 that is an example of a protective plate that protects the nozzle surface 15 is provided in the head main body 12. The cover head 16 is configured from an opening portion 16*a* by which the nozzle row 14 is exposed, and a frame portion 16*b* that defines the opening portion 16*a*. The frame portion 16*b* protects the nozzle surface 15 by covering the peripheral edge portion of the nozzle surface 15.

Although not specifically shown in the drawings, a pressure generating chamber that configures a portion of a flow channel that communicates with the nozzle opening 11, and a pressure generating unit by which a pressure change is generated in the pressure generating chamber and causing ink to be ejected from the nozzle opening are provided inside the head main body 12.

Although the pressure generating unit is not particularly limited, examples thereof using a piezoelectric element in which a piezoelectric material that exhibits an electromechanical conversion function is interposed between two electrodes, or having a heat generating element arranged in the pressure generating chamber and ejecting droplets from the nozzle opening 11 through a bubble generated with the heat from the heat generating element, or in which static electricity is generated between a diaphragm and an electrode and droplets are caused to be ejected from the nozzle opening 11 by the diaphragm being deformed due to the electrostatic force may be used. A flexural oscillation-type piezoelectric element in which a lower electrode, a piezoelectric material and an upper electrode are layered from the pressure generating chamber side are caused to flexurally deform, or a longitudinal oscillation-type piezoelectric element in which a piezoelectric material and an electrode forming material are alternately layered and caused to expand and contract in the axial direction, or the like may be used as the piezoelectric element.

A flow channel member 13 supplies ink from outside to the head main body 12 or discharges ink from the head main body 12 to the outside. The flow channel member 13 is fixed to the surface of the head main body 12 on the side opposite to the nozzle openings 11. An ink flow channel connection portion 17 and a connector 18 are provided on the upper surface of the flow channel member 13.

The ink flow channel connection portion 17 is a part that connects an internal flow channel of the flow channel member 13 to an external flow channel. The connector 18 is a part by which an electronic signal, such as a print signal from the outside, is supplied, and is connected to a connection wiring 19. The connection wiring 19 is a member having flexibility, such as FPC that transmits the print signal.

A fixing portion 20 that protrudes in the Y direction is provided on the flow channel member 13. The fixing portion 20 is formed in a plate shape nearly parallel to the YZ plane, and is provided at the approximate center portion in the X direction of the flow channel member 13. A fixing screw insertion hole 22 penetrating in the thickness direction is provided in the fixing portion 20.

Figure 7:
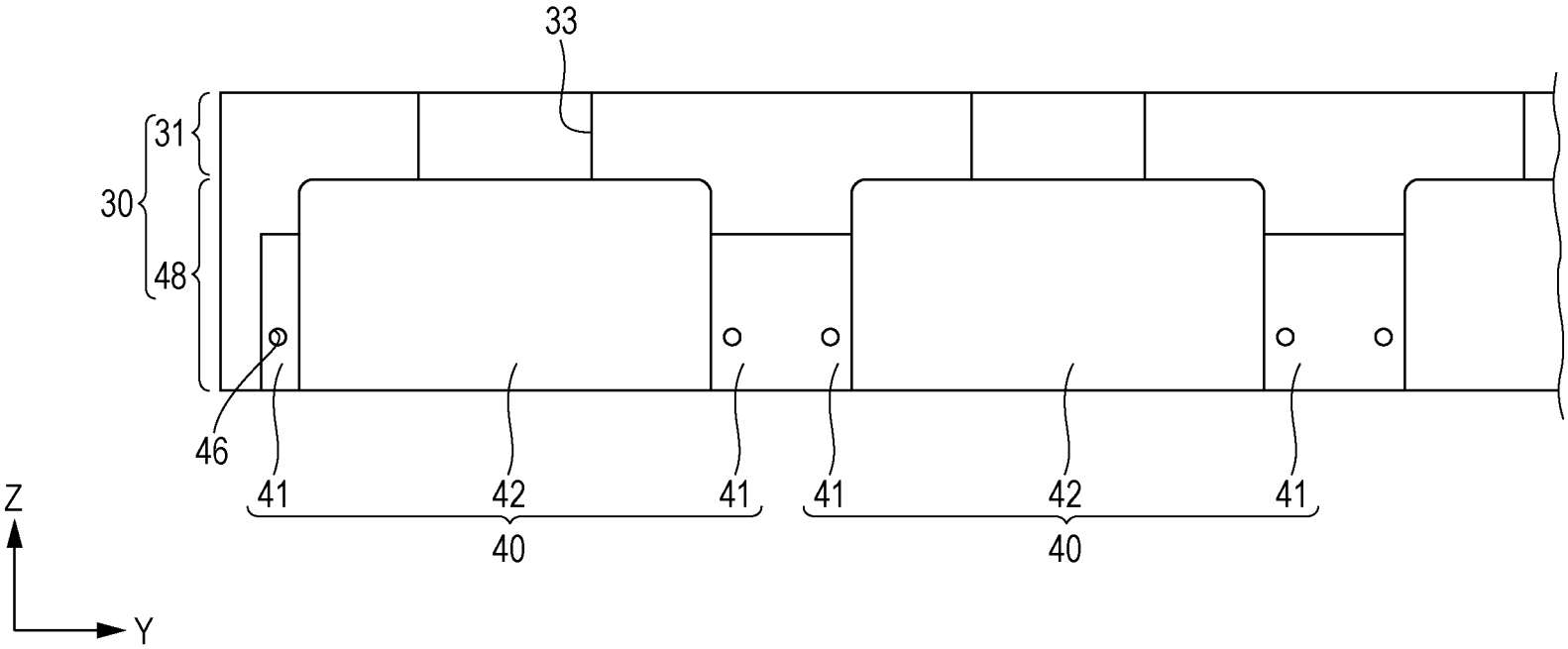
FIG. 7 is a front view of a holding member according to Embodiment 1.
Figure 8:
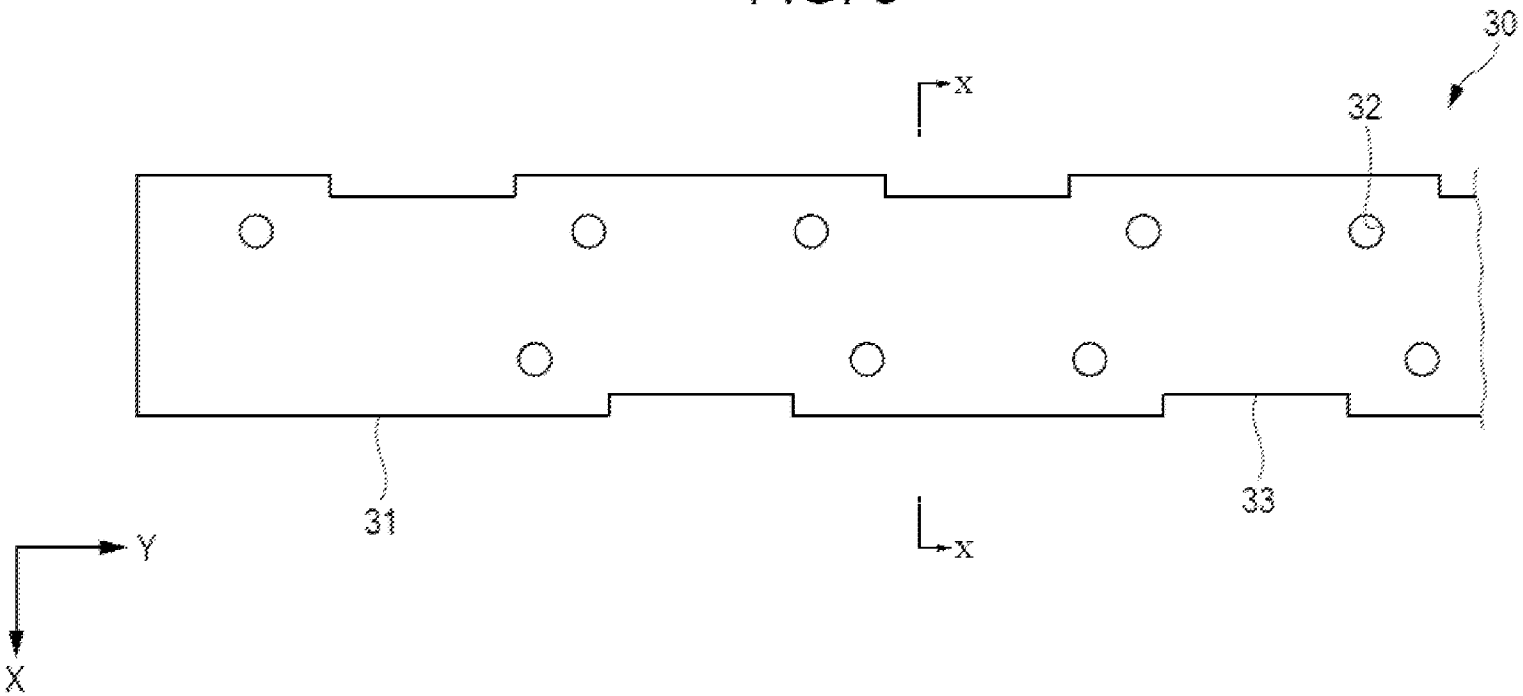
FIG. 8 is a top view of the holding member according to Embodiment 1.
Figure 9:
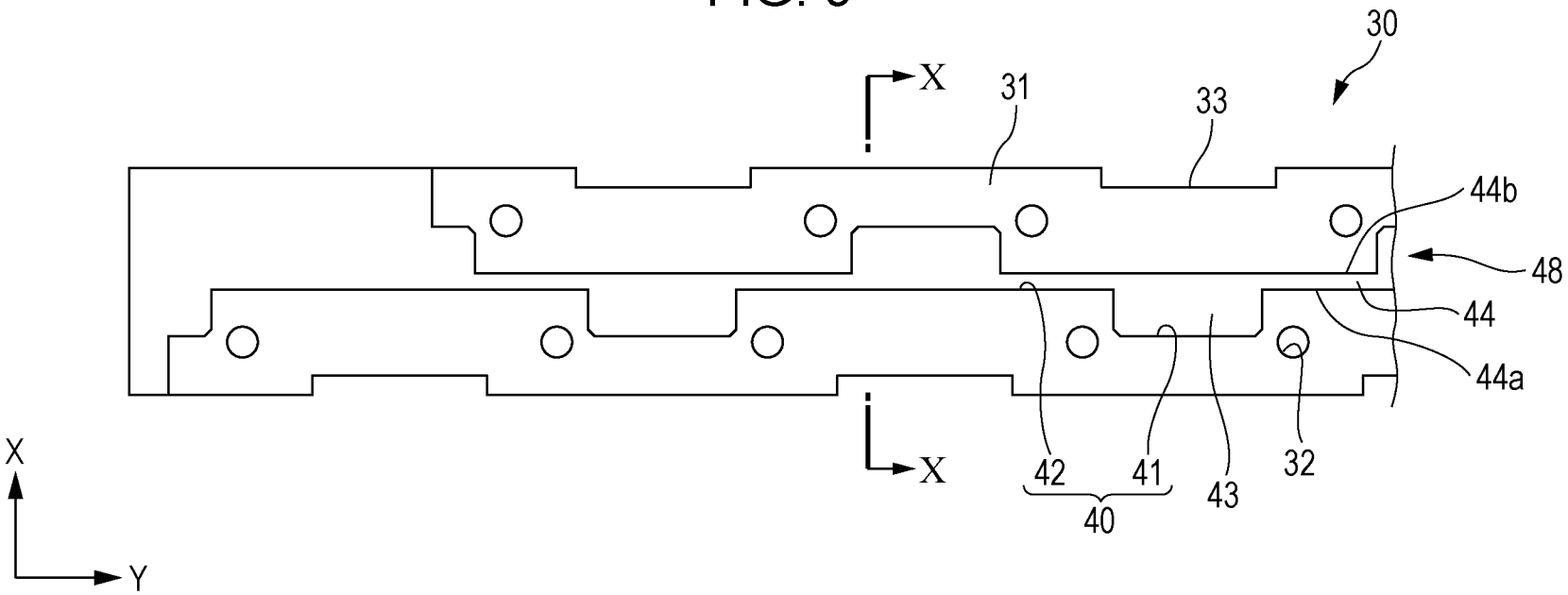
FIG. 9 is a bottom view of the holding member according to Embodiment 1.
Figure 10:
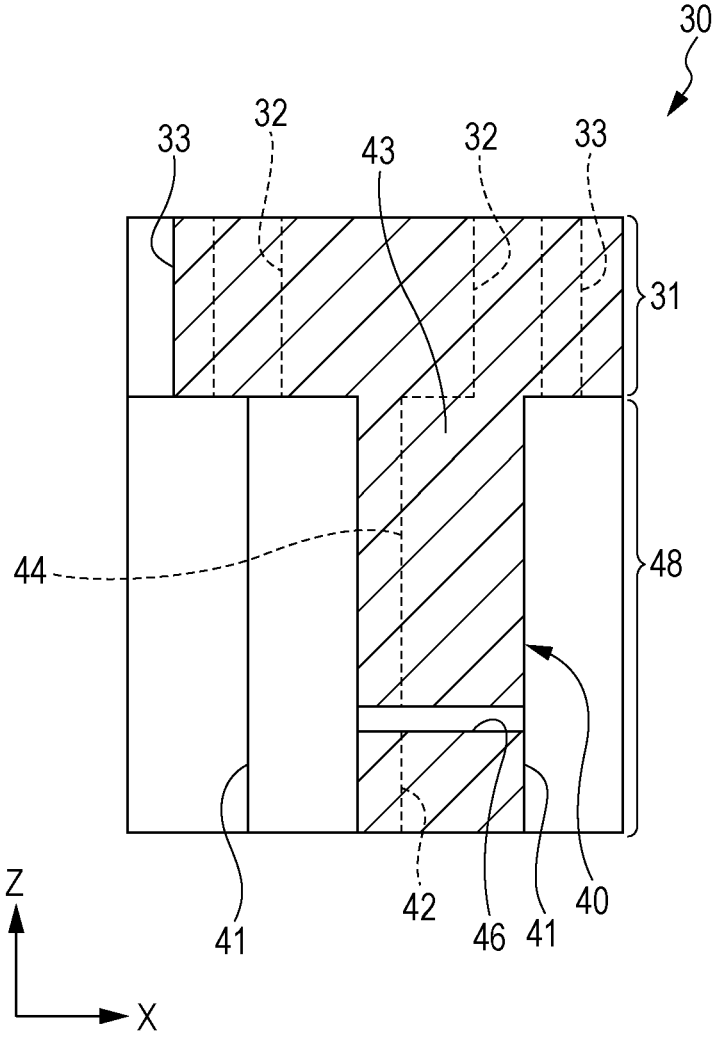
FIG. 10 is a cross-sectional view taken along the line X-X in FIGS. 8 and 9.

The holding member will be described in detail using FIGS. 7 to 10. FIG. 7 is a front view of the holding member, FIG. 8 is a top view of the holding member, FIG. 9 is a bottom view of the holding member, and FIG. 10 is a cross-sectional view taken along line X-X in FIGS. 8 and 9.

The holding member 30 is a member that holds the head row 10A and the head row 10B by being formed elongated in the Y direction. The holding member 30 includes a base portion 31 disposed on the upper portion of the holding member, and a holding portion forming portion 48 disposed on the lower portion of the holding member.

The base portion 31 is formed in a plate shape having a surface nearly parallel to the nozzle surface 15 (refer to FIG. 5), and positioned on the upper surface side of each head 10. A connection flow channel 32 penetrating in the thickness direction is provided in the base portion 31. The connection flow channel 32 is fit to the ink flow channel connection portion 17 (refer to FIG. 3) of the head 10. Although not specifically shown in the drawings, ink is supplied from a liquid storage unit such as an ink cartridge to the connection flow channel 32 via a tube or the like. Then, the ink supplied to the connection flow channel 32 is supplied to the ink flow channel connection portion 17 and supplied to the head main body 12. In the embodiment, two connection flow channels 32 are provided in the base portion 31 for each head 10.

A connection wiring concavity 33 is provided in the side surface (surface parallel to the YZ plane) of the base portion 31. The connection wiring 19 connected to the head 10 is accommodated in the connection wiring concavity 33.

The holding portion forming portion 48 is a member in which a plurality of holding portions 40 is formed. In the embodiment, the holding portion forming portion 48 is formed long in the Y direction and short in the X directions and has a plate form erected on the base portion 31, and a plurality of holding portions 40 to which each head 10 is attached is formed on both side surfaces orthogonal to the Y direction. The head row 10A and the head row 10B are arranged at both sides of such a plurality of holding portions 40 (holding portion forming portion 48) in the Y direction and fixed to the holding member.

The holding portion 40 is a region from the holding member 30 to which each head 10 is attached, and in the embodiment, is a region that includes a head attachment surface 41 and an accommodation portion 42. The head attachment surface 41 is a region to which the fixing portion 20 of the head 10 is attached, and the accommodation portion 42 is a space in which the head main body 12 of the head 10 and the flow channel member 13 are accommodated. In the embodiment, the head attachment surface 41 and the accommodation portion 42 are formed as below.

The holding portion forming portion 48 includes a plurality of thick portions 43 that are relatively thick in the X direction, and thin portions 44 that are formed to be thinner than the thick portions 43. The thick portion 43 is a site protruded from the thin portion 44 in the X direction. At both side surfaces (side surface 44*a*, side surface 44*b*) of the holding portion forming portion 48, the region between the adjacent thick portions 43 in the Y direction becomes the accommodation portion 42, and the surface (surface orthogonal to the Y direction) of the thick portion 43 becomes the head attachment surface 41.

The thick portions 43 on the side surface 44*a* and the side surface 44*b* of the holding portion forming portion 48 are arranged in a zig-zag pattern along the Y direction. That is, the thick portion 43 on the side of the side surface 44*a* (side surface 44*b*) of the holding portion forming portion 48 is provided such that the position thereof in the Y direction overlaps the accommodation portion 42 of the side surface 44*b* (side surface 44*a*) side. Although described in detail later, by forming holding portions 40 that include such accommodation portions 42, the holding portions 40 are arranged in a zig-zag pattern along the Y direction, and each head 10 held by each holding portion 40 is arranged in zig-zag pattern.

On the head attachment surface 41, a fixing screw hole 46 that penetrates in the width direction (X direction) of the thick portion 43 is provided. The fixing screw hole 46, which will be described in detail later, is a screw hole to which the fixing screw inserted in the fixing screw insertion hole 22 (refer to FIG. 3) of the head 10 is screwed. The head 10 is fixed to the head attachment surface 41 by the fixing screw.

In addition, the accommodation portion 42 positioned to one surface side from both side surfaces (side surface 44*a* side, side surface 44*b* side) of the holding portion forming portion 48 is provided to overlap and oppose the head attachment surface 41 (thick portion 43) positioned on the other surface side in the Y direction. Meanwhile, one head attachment surface 41 is provided between two adjacent accommodation portions 42 in the Y direction. Each fixing portion 20 of two heads 10 respectively accommodated in the adjacent accommodation portions 42 is fixed to one head attachment surface 41.

In the embodiment, at both side surfaces of the respective holding portion forming portion 48, three accommodation portions 42 are provided corresponding to the head row 10A and the head row 10B, and a head attachment surface 41 is provided at both end sides of each accommodation portion 42 in the Y direction. Although described in detail later, by attaching each head 10 to holding portion 40 having such a head attachment surface 41 and accommodation portion 42, the head row 10A and the head row 10B are arranged and opposed with the holding portion 40 interposed, and are arranged in a zig-zag pattern along the Y direction.

The holding member 30 is integrally formed with a base portion 31 and a holding portion forming portion 48 having a plurality of holding portions 40. By being integrally formed in this way, the rigidity of the base portion 31 and the holding portion 40 is improved. Naturally, the base portion 31 and the holding portion forming portion 48 may each be formed as separate members, and the holding member 30 may be formed by bonding these. In addition, although the material of the holding member 30 is not particularly limited, it is preferable that a material having rigidity, such as SUS, be used.

Figure 11:
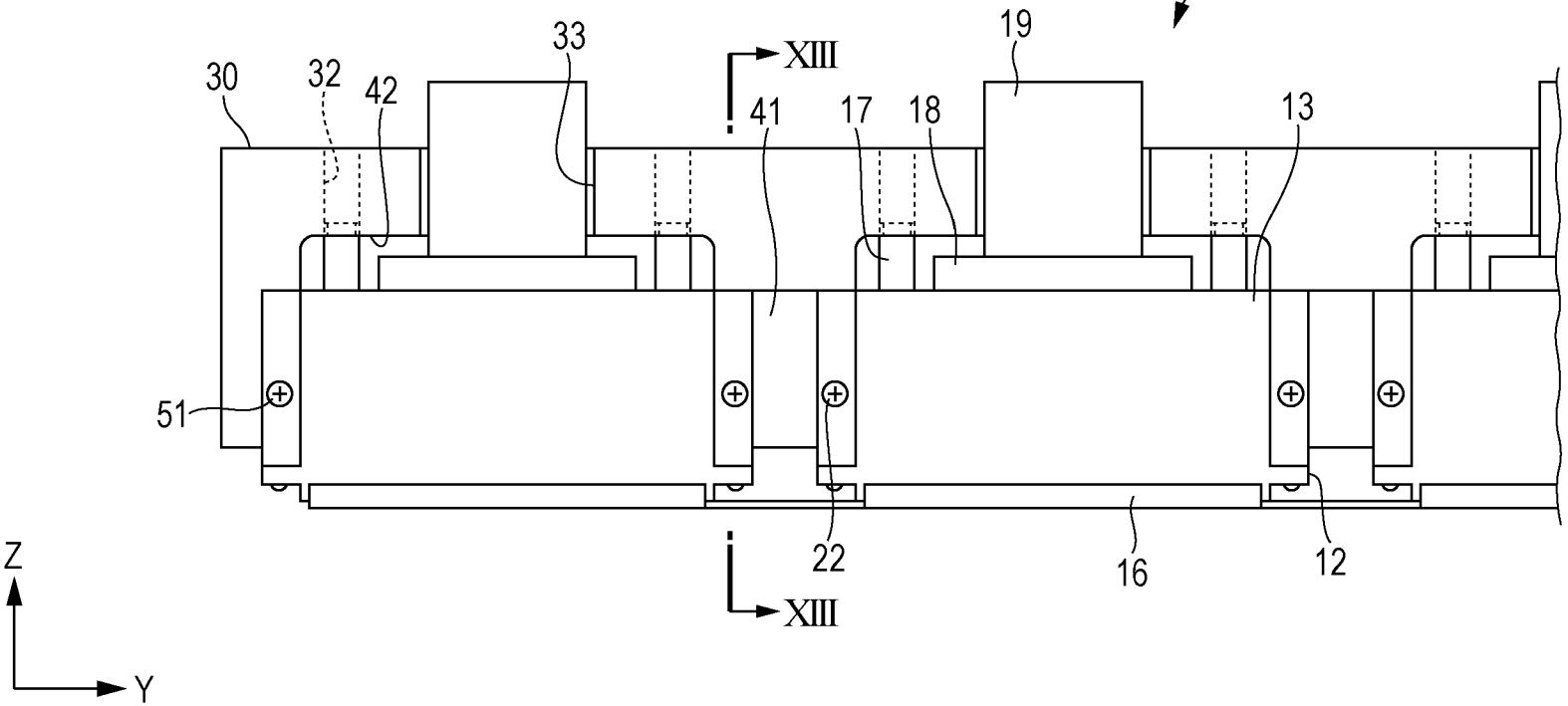
FIG. 11 is a front view of the head unit according to Embodiment 1.
Figure 12:
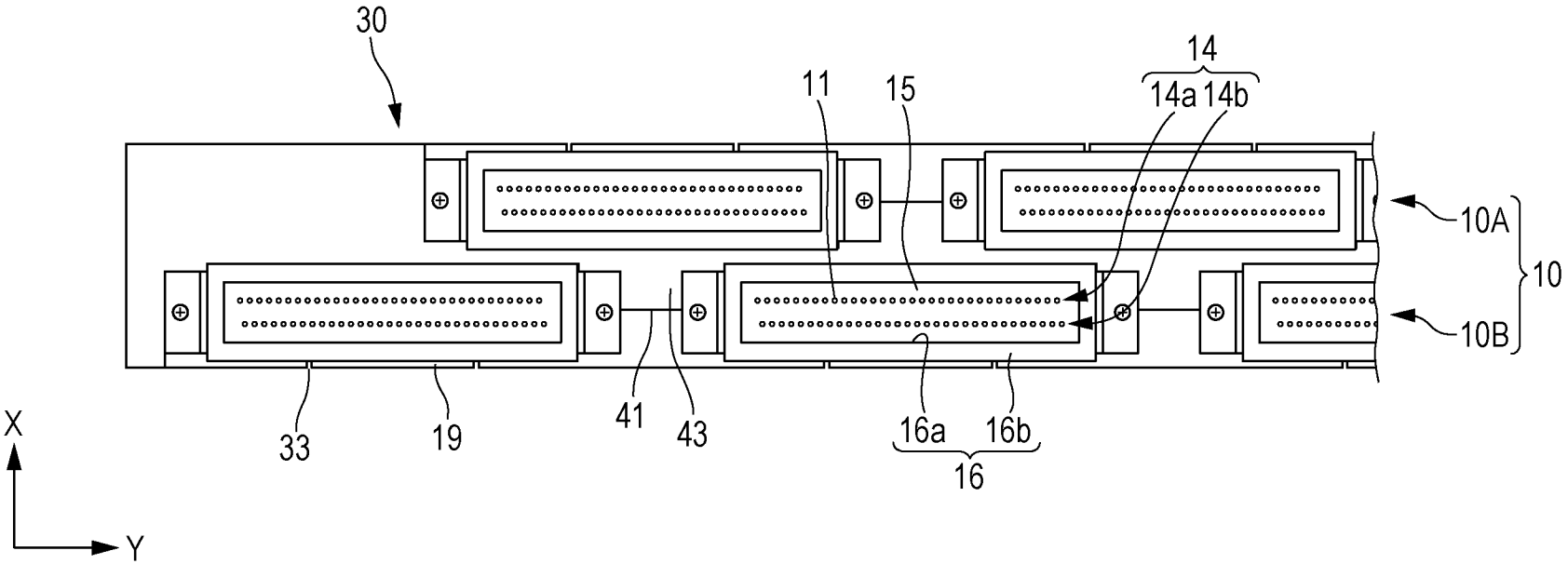
FIG. 12 is a bottom view of the head unit according to Embodiment 1.
Figure 13:
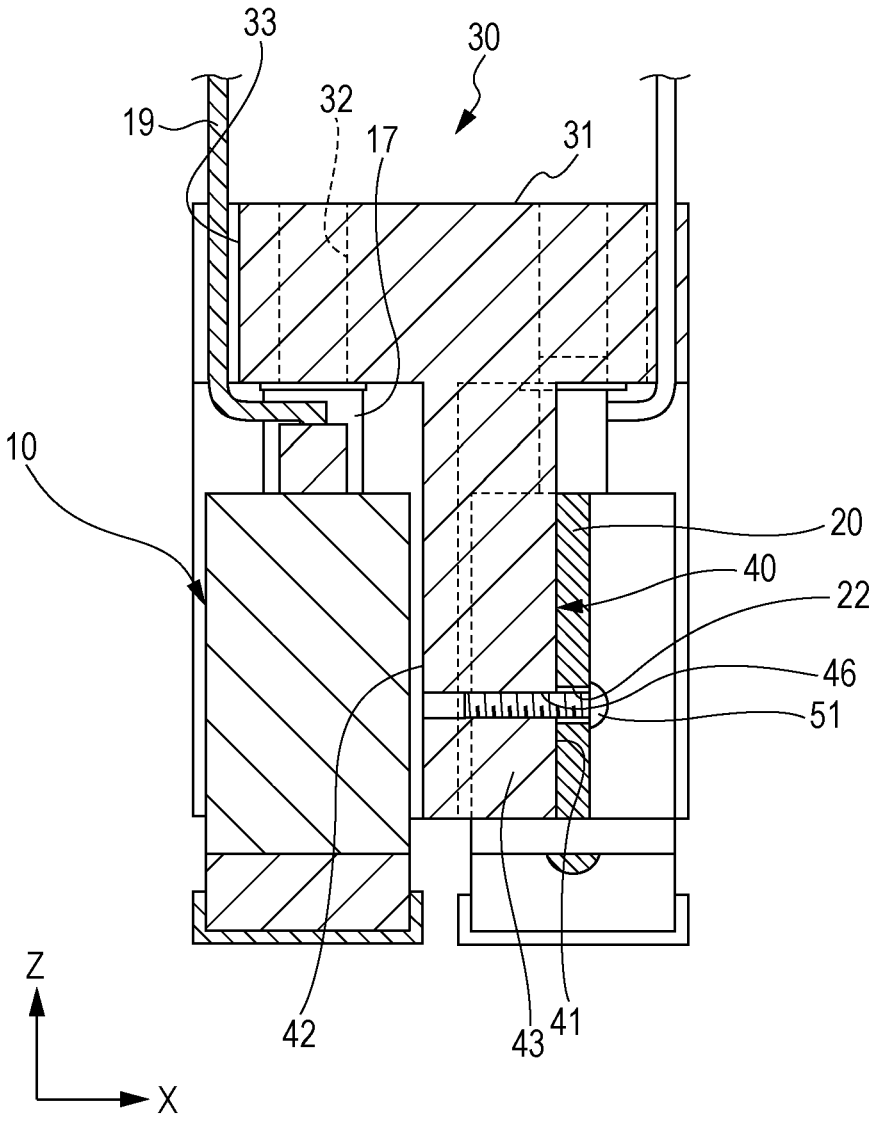
FIG. 13 is a cross-sectional view taken along the line XIII-XIII in FIG. 11.

The head attached to the holding member will be described in detail using FIGS. 11 to 13. FIG. 11 is a front view of the head unit, FIG. 12 is a bottom view of the head unit, and FIG. 13 is a cross-sectional view taken along line XIII-XIII in FIG. 11.

The head row 10A and the head row 10B are arranged in a zig-zag pattern along the Y direction with the holding portion 40 of the holding member 30 interposed. That is, on both side surfaces of the holding member 30, each head 10 that configures the head row 10A and the head row 10B is fixed to each holding portion 40. More specifically, the heads 10 are fixed as below.

For each head 10, the fixing portion 20 abuts the head attachment surface 41 and head main body 12 and the flow channel member 13 are accommodated in each accommodation portion 42. In addition, the fixing screw 51 is inserted in the fixing screw insertion hole 22 provided in the fixing portion 20, and screwed into the fixing screw hole 46 provided in the head attachment surface 41. The fixing screw 51 is not screwed into the fixing screw insertion hole 22, and the fixing portion 20 is fixed to the head attachment surface 41 in the head portion.

In the head 10 fixed in this manner, an ink flow channel connection portion 17 is fitted with a connection flow channel 32 and communicates with the inner portion. In so doing, although not specifically shown in the drawings, ink is supplied from an ink storage unit, such as an ink cartridge, to the connection flow channel 32 via a tube or the like, and further supplied to the head main body 12 via the ink flow channel connection portion 17.

The connection wiring 19 connected to the head 10 is accommodated in a connection wiring concavity 33 provided in the base portion 31, and the end portion thereof is connected to a control device (not shown) that supplies a driving signal. By providing the connection wiring concavity 33 in the base portion 31, it is possible to accommodate the connection wiring 19 without protruding from the side surface of the base portion 31.

In the embodiment, the relative positions of each of the heads 10 to one another are positioned to have predetermined arrangement. Here, the relative positions of each of the heads 10 to one another indicates the arrangement of each head 10 such that the nozzle row 14 of each head 10 forms a single continuous nozzle row unit, and arranging each head 10 in a zig-zag pattern in the Y direction.

Arranging each head 10 in a zig-zag pattern in the Y direction indicates the arrangement as below. That is, the nozzle opening 11 (one or a plurality thereof) that is positioned at the end portion side of the head 10 of the head row 10A (head row 10B) in the Y direction is arranged so that the position in the Y direction overlaps the nozzle opening 11 of the head 10 of the head row 10B (head row 10A).

Thus, the nozzle rows 14 are made continuous by the nozzle rows 14 between each head 10 being partially overlapped in the Y direction, and a nozzle row unit that forms the overall maximum printing width is configured. That is, the nozzle row unit indicates the nozzle rows 14 of all of the heads 10 of the head unit 1 being made continuous.

For the head unit 1 including each head 10 for which the relative positions are regulated as described above, ink is supplied from an ink cartridge not shown in the drawings to each head 10, and ink droplets are ejected from the nozzle openings 11 based on the driving signal from a control device.

Figure 14:
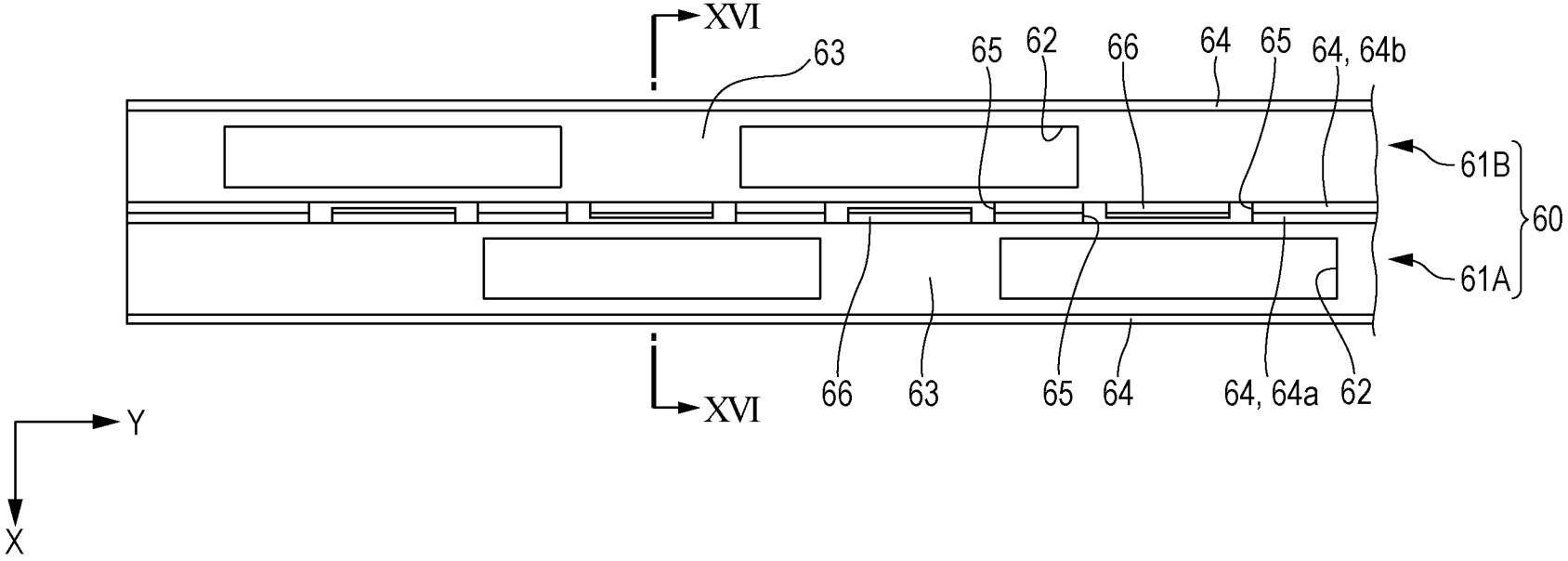
FIG. 14 is a top view of a cover according to Embodiment 1.
Figure 15:
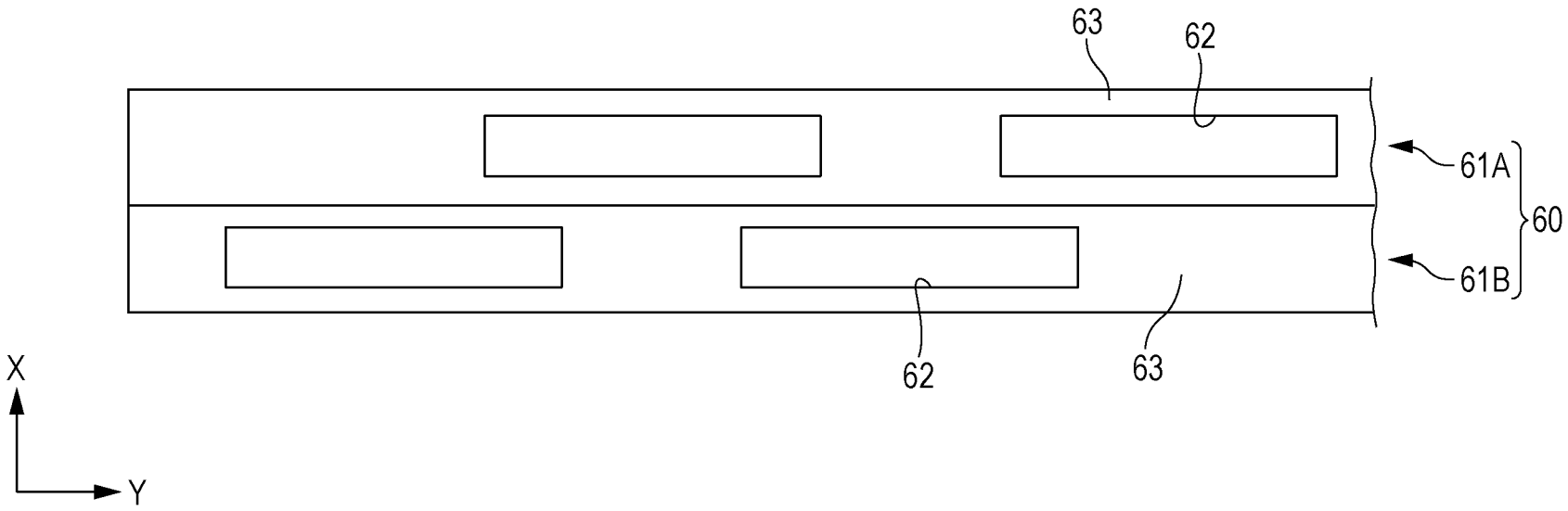
FIG. 15 is a bottom view of the cover according to Embodiment 1.
Figure 16A:
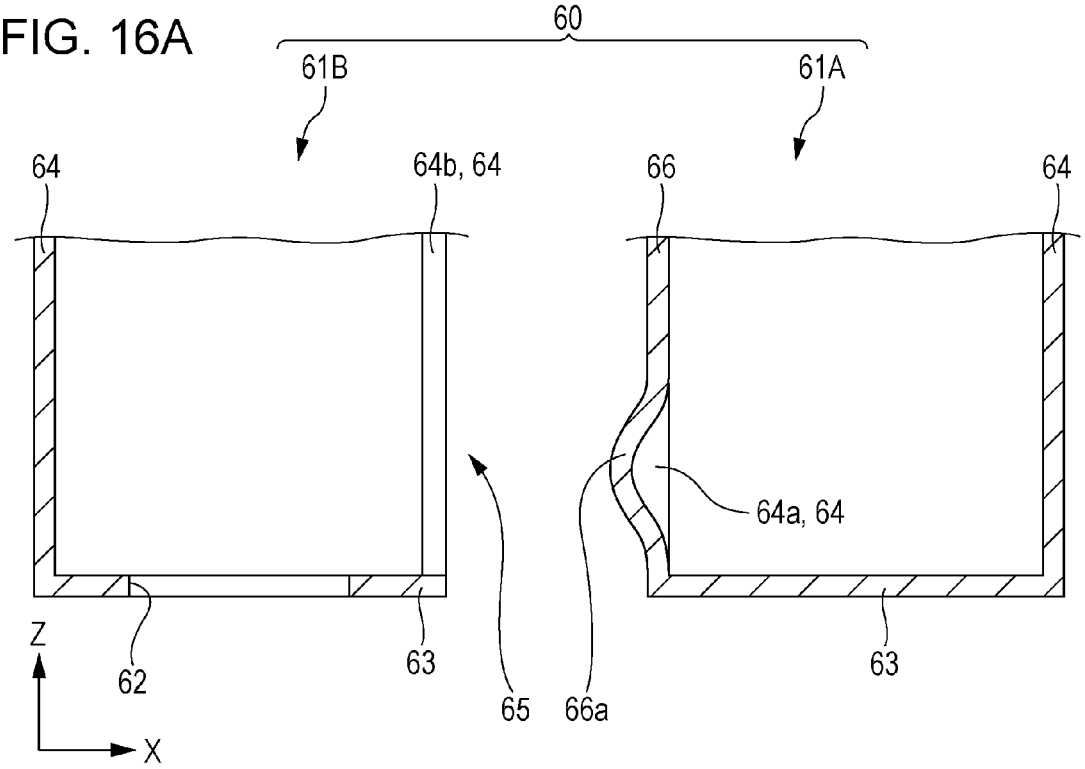
FIGS. 16A and 16B are cross-sectional views taken along lines XVIA-XVIA and XVIB-XVIB in FIG. 14, respectively.
Figure 16B:
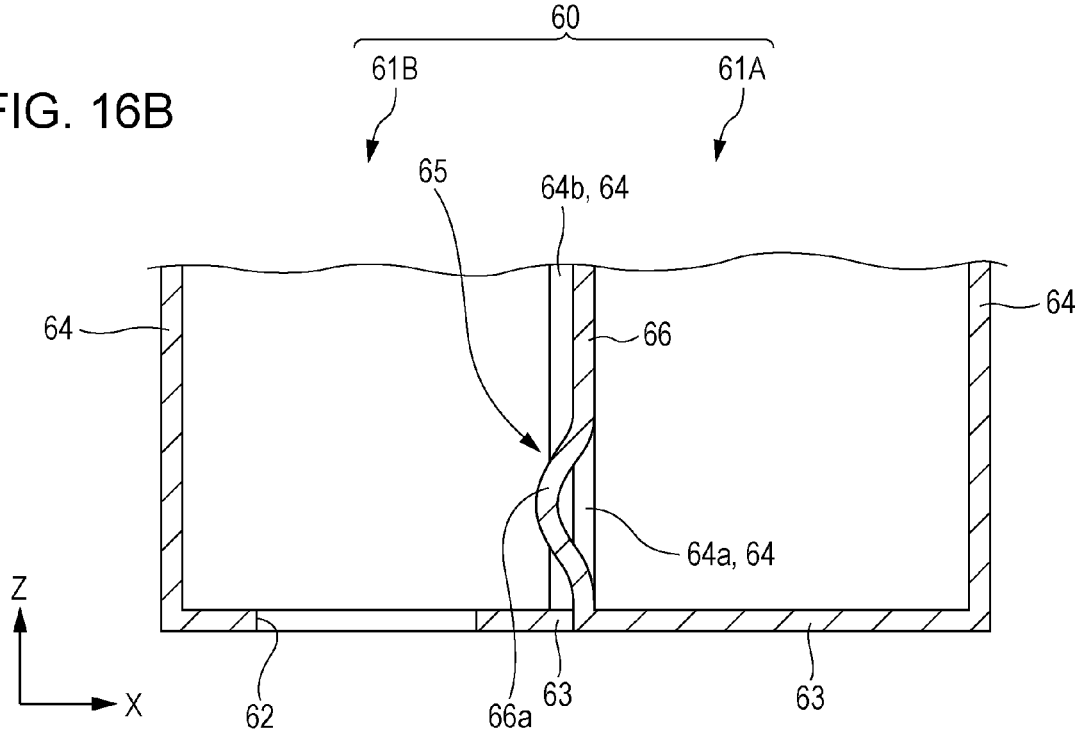

The cover 60 will be described in detail using FIGS. 14 to 16B. FIG. 14 is a top view of the cover, FIG. 15 is a bottom view of the cover, and FIGS. 16A and 16B are cross-sectional views taken along line XVIA-XVIA, XVIB-XVIB in FIG. 14.

The cover 60 covers between the head 10 and the nozzle surface 15 of each head 10. The cover 60 according to the embodiment includes two cover portions 61A and 61B that are long in the Y direction bonded together. In a case in which the each of the cover portion 61A and cover portion 61B are not distinguished, they are referred to as a cover portion 61.

The cover portion 61 includes a bottom plate 63 in which a plurality of opening portions 62 is formed, and a side plate 64 perpendicular to the bottom plate 63. The cover portion 61 according to the embodiment is formed from a metal plate, such as SUS, and the bottom plate 63 and the side plate 64 are formed by folding back both ends of the metal plate along a straight line parallel to the Y direction.

A plurality of opening portions 62 is formed along the Y direction in the bottom plate 63. In the opening portion 62, the nozzle surface 15 of the head 10 is formed at a predetermined position so as to be exposed.

For each cover portion 61, the side plates 64 are bonded to one another, and a single cover 60 is configured. A notch portion 65 and a conducting portion 66 are formed in the side plates 64 bonded to one another. The side plate 64 bonded to the cover portion 61B of the cover portion 61A is also referred to as a side plate 64*a*. The side plate 64 bonded to the cover portion 61A of the cover portion 61B is also referred to as a side plate 64*b*.

A plurality of notch portions 65 are formed in the cover portion 61A by notching a part of the side plate 64*a*. The notch portions 65 are formed so as to be positioned to the side of each opening portion 62 of the cover portion 61A. Similarly, a plurality of notch portions 65 are formed in the cover portion 61B by notching a part of the side plate 64*b*. The notch portions 65 are formed so as to be positioned to the side of each opening portion 62 of the cover portion 61B.

On the cover portion 61A, a plurality of conducting portions 66 formed so that the upper end thereof becomes the free end and separated from the side plate 64*a* is erected on the bottom plate 63. Each conducting portion is arranged so as to oppose the notch portion 65 formed in the side plate 64*b* of the other side cover portion 61B. That is, the side plate 64*a*, notch portion 65, and conducting portion 66 are formed in the cover portion 61A lined up in substantially the same plate (YZ plane).

Similarly, on the cover portion 61B, a plurality of conducting portions 66 formed so that the upper end thereof becomes the free end and separated from the side plate 64*b* is erected on the bottom plate 63. Each conducting portion is arranged so as to oppose the notch portion 65 formed in the side plate 64*a* of the other side cover portion 61A. That is, the side plate 64*b*, notch portion 65, and conducting portion 66 are formed in the cover portion 61B lined up in substantially the same plate (YZ plane).

As shown in FIGS. 16A and 16B, the conducting portion 66 of the cover portion 61B (cover portion 61A) is arranged so as to oppose the notch portion 65 of the cover portion 61A (cover portion 61B), and the cover 60 is configured by bonding the side plate 64*a* and the side plate 64*b* to one another.

Each conducting portion 66 formed on the cover 60 includes a bent portion 66*a* that is bent. The bent portion 66*a* is a site that conducts by contacting the cover head 16 of the head 10.

The cover 60 with such a configuration is attached to the holding member 30 to which the head 10 fixed, as shown in FIGS. 1 to 3.

More specifically, the bottom plate 63 of the cover 60 covers the nozzle surface 15 side of the head 10, the side plate 64 covers the side surface of the head 10 and the side plate 64 is fixed to the holding member 30.

The opening portion 62 formed in the bottom plate 63 of the cover 60 is positioned so as to oppose the nozzle surface 15 of each head 10, and the nozzle surface 15 is exposed from the opening portion 62.

In a state in which the cover 60 is not attached, as shown in FIG. 12, a step difference in the Z direction occurs between the nozzle surfaces 15 of the heads 10. That is, although the nozzle surfaces 15 of each head 10 are positioned in substantially the same plane, the head main body 12, fixing portion 20 or the like therebetween are not in the same plane in the Z direction as the nozzle surfaces 15.

Meanwhile, as shown in FIG. 2, in a state in which the cover 60 is attached, the bottom plate 63 covers between the nozzle surfaces 15 of each head 10. In so doing, the bottom surface of the head unit 1, other than the opening portions 62, becomes flush.

Thereby, by making the bottom surface of the head unit 1 more flush than the cover 60, it is possible to reduce disturbance to the air flow in the bottom surface side of the head unit 1 during printing. Because such air flow disturbance is reduced, it is possible for ink droplets ejected from the head 10 to be more precisely landed at a predetermined position.

Additionally, in a case in which the cover 60 is not attached, disturbance of the air flow occurs between the head unit 1 and a recording medium, such as paper, by the step difference formed between the nozzle surfaces 15 of the heads 10 during printing. When such an air flow disturbance occurs, the ejection direction of the ink droplets ejected from the head 10 is disturbed, and the landing positions are shifted.

The conducting portions 66 (bent portion 66*a*) provided in the cover 60 contact and conduct with the cover head 16 of the head 10. More specifically, the side plate 64*a* and the side plate 64*b* of the cover portion 61A and the cover portion 61B enter between the head row 10A and the head row 10B. The conducting portion 66 of the cover portion 61A contacts the cover head 16 of the head 10 on the head row 10B side. Similarly, the conducting portion 66 of the cover portion 61B contacts the cover head 16 of the head 10 on the head row 10A side.

By abutting the bent portion 66*a* of the conducting portion 66 on the cover head 16, the bent portion 66*a* is pressed towards the inside of the cover portion 61. That is, the bent portion 66*a* is elastically deformed to the inside of the cover portion 61, and the counterforce of the bent portion 66*a* acts on the cover head 16. In so doing, it is possible for conduction to be established by the conducting portion 66 and the cover head 16 being in more reliable contact.

Although not specifically shown in the drawings, a grounding portion connected to the ground is provided on the carriage of the ink jet recording apparatus in which the head unit 1 is mounted. The grounding portion is configured to be able to contact the holding member 30 of the head unit 1 mounted on the carriage.

Accordingly, the cover head 16 of each head 10 is grounded by conducting with the grounding portion of the carriage via the cover 60 (each conducting portion 66). Thereby, each head 10 is electrically connected to the carriage via the cover head 16 or the cover 60. Thereby, each head 10 is not charged or a charged electrical charge is discharged. Thereby, it is possible to suppress a piezoelectric element or the like of the head 10, or a driver IC or the like for driving the piezoelectric element or the like from being damaged.

In the head unit 1, the cover 60 functions as a common grounding member by which the plurality of heads 10 are grounded.

Accordingly, it is not necessary to provide a plurality of grounding portions by which each head 10 is grounded on the carriage. In so doing, it is possible to reduce the space in which components by which conduction is established between each head 10 and the carriage. Since a grounding portion corresponding to the cover 60 is not provided on the carriage, it is possible to reduce costs by suppressing the number of components.

Because the cover 60 serves a ground function by which each head 10 is grounded and a rectifying function that suppresses air flow disturbances during printing, it is possible to reduce the cost of components, and the time and effort or costs associated with manufacturing compared to a case in which these functions are separately configured.

Furthermore, the cover 60 is attachable and detachable, the conducting portions 66 of the cover 60 are configured to conduct through contact with the cover head 16. That is, the conducting portion 66 is not configured to conduct in a fixed manner through a fastening tool such as a screw. In so doing, it is possible for each head 10 to electrically conduct with the ground simply by attaching the cover 60. In so doing, when the cover 60 is replaced, if the old cover 60 is removed, and a new cover 60 is attached, conduction is also achieved, it is therefore possible to reduce the time and effort associated with replacing the cover 60.

As described above, the head unit 1 according to the embodiment serves a function of grounding the cover 60 by providing the conducting portions 66 on the cover 60 that protects the head 10. In so doing, it is possible to achieve space savings and cost reductions by reducing the number of grounding members for grounding each head 10.

Figure 17:
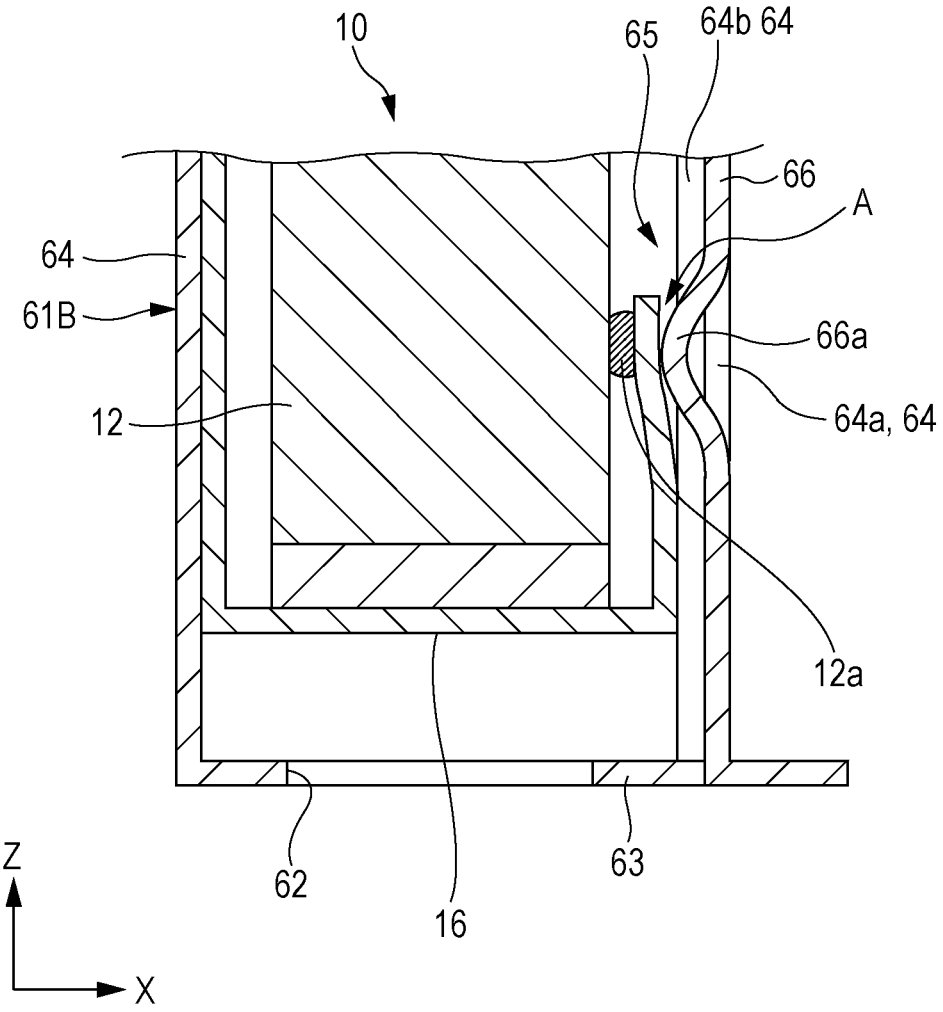
FIG. 17 is an enlarged cross-sectional view of the main portions of a head unit according to a modification example.

Because conduction is much more reliably established between the conducting portions 66 of the cover 60 and each head 10, a configuration as below may be used. FIG. 17 is an enlarged cross-sectional view of the main portions of the head unit according to a modification example.

The cover head 16 is provided on the head 10, and a protrusion 12*a* is provided between the cover head 16 and the head 10 in the head main body 12. The protrusion 12*a* is provided at a position opposing the region A abutted by the conducting portion 66 (bent portion 66*a*) of the cover head 16.

If such a cover 60 is attached, one side surface of the region A is pressed to the bent portion 66*a* of the conducting portion 66. The head main body 12 side is bent and contacts the protrusion 12*a* by the region A being pressed. The region A of the cover head 16 is also pressed to the bent portion 66*a* side by the counterforce from the protrusion 12*a*. As a result, it is possible to more reliably establish contact between the bent portion 66*a* of the conducting portion 66 and the region A of the cover head 16.

Such a protrusion 12*a* is not limited to a case of being provided on the head 10, and may be provided on the cover head 16.

Embodiment 2

The head unit 1 according to Embodiment 1 has a configuration in which conduction is established between the conducting portion 66 provided on the cover 60 and the cover head 16 (protective plate) of the head 10 by direct contact; however there is no limitation to such a form. For example, the conducting portion 66 may indirectly conduct with the cover head 16.

Figure 18:
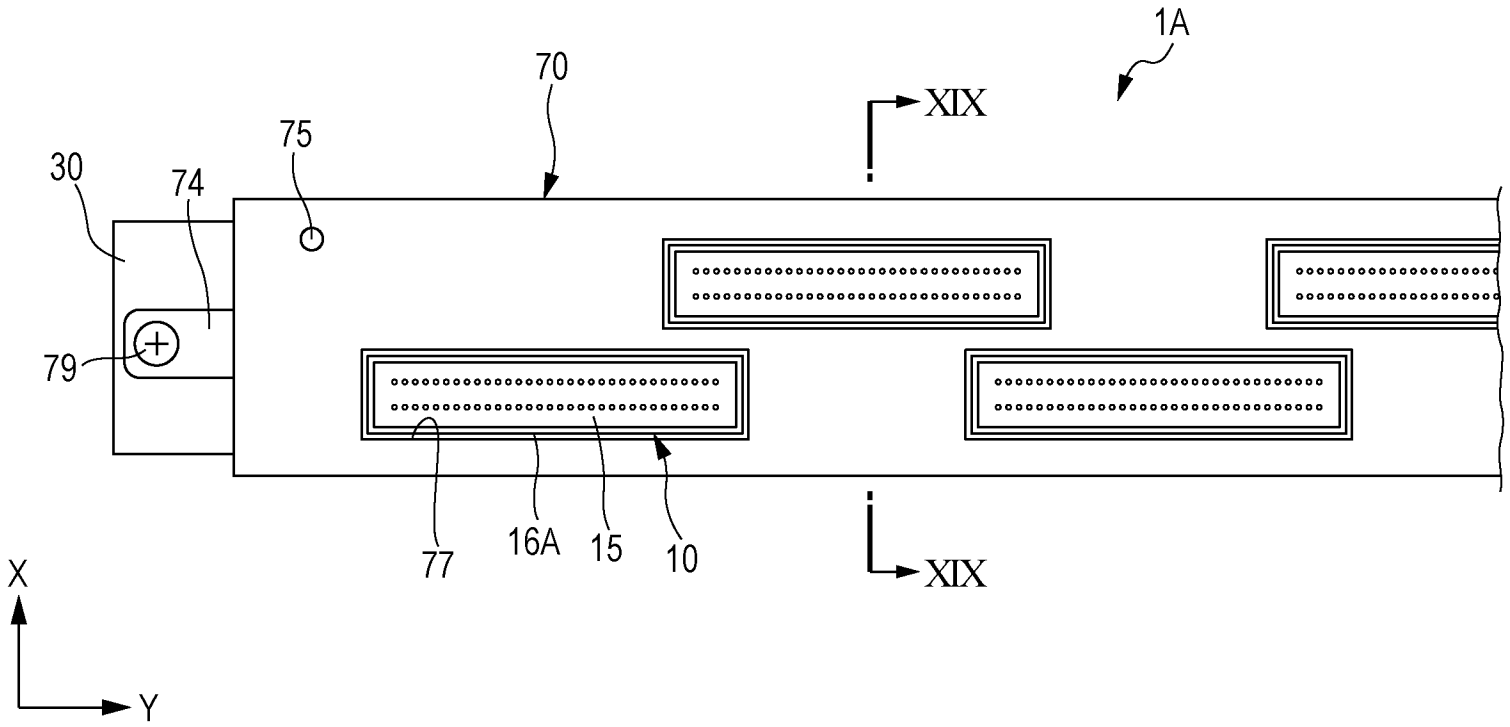
FIG. 18 is a bottom view of a head unit according to Embodiment 2.
Figure 19:
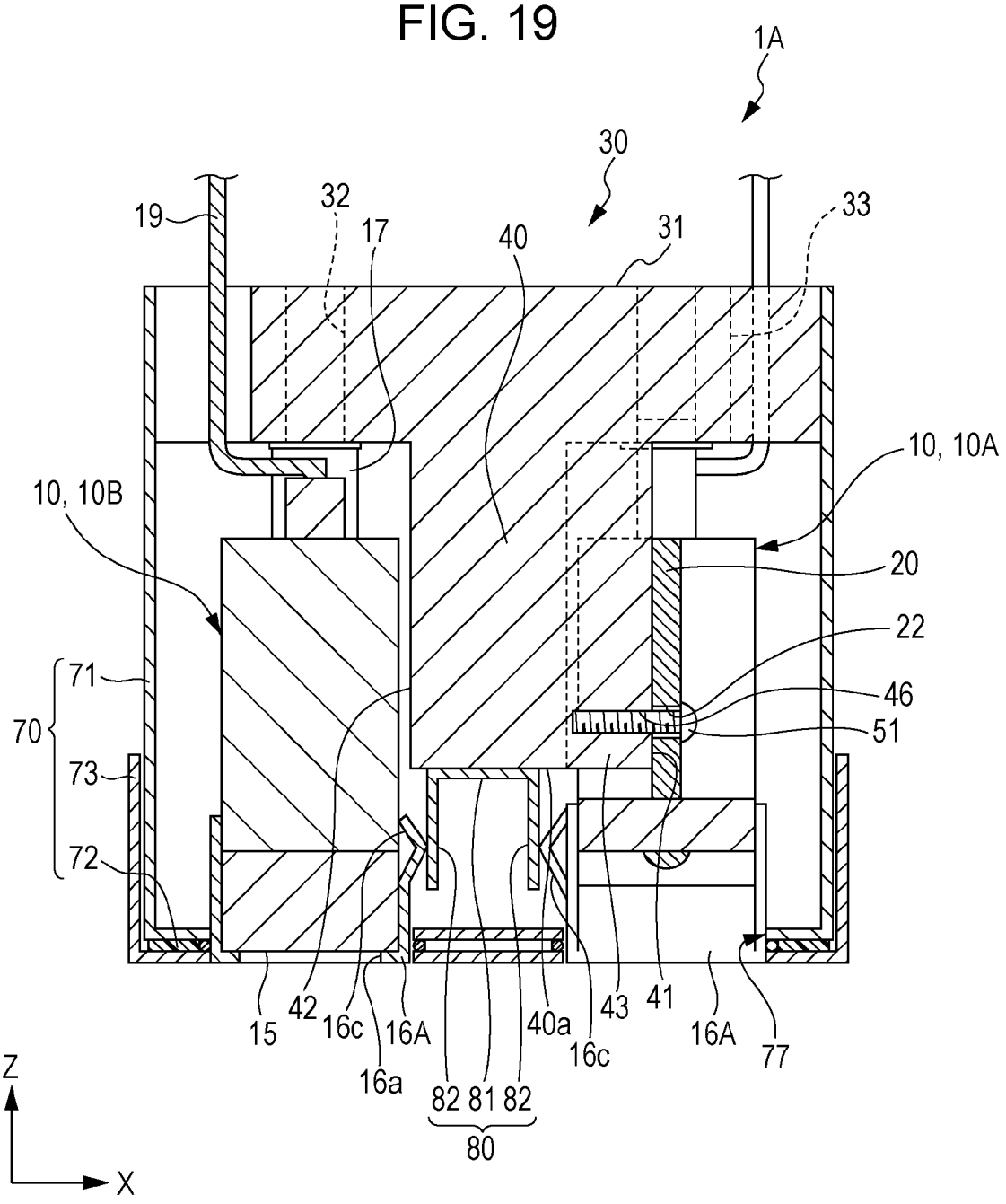
FIG. 19 is a cross-sectional view taken along line XIX-XIX in FIG. 18.
Figure 20:
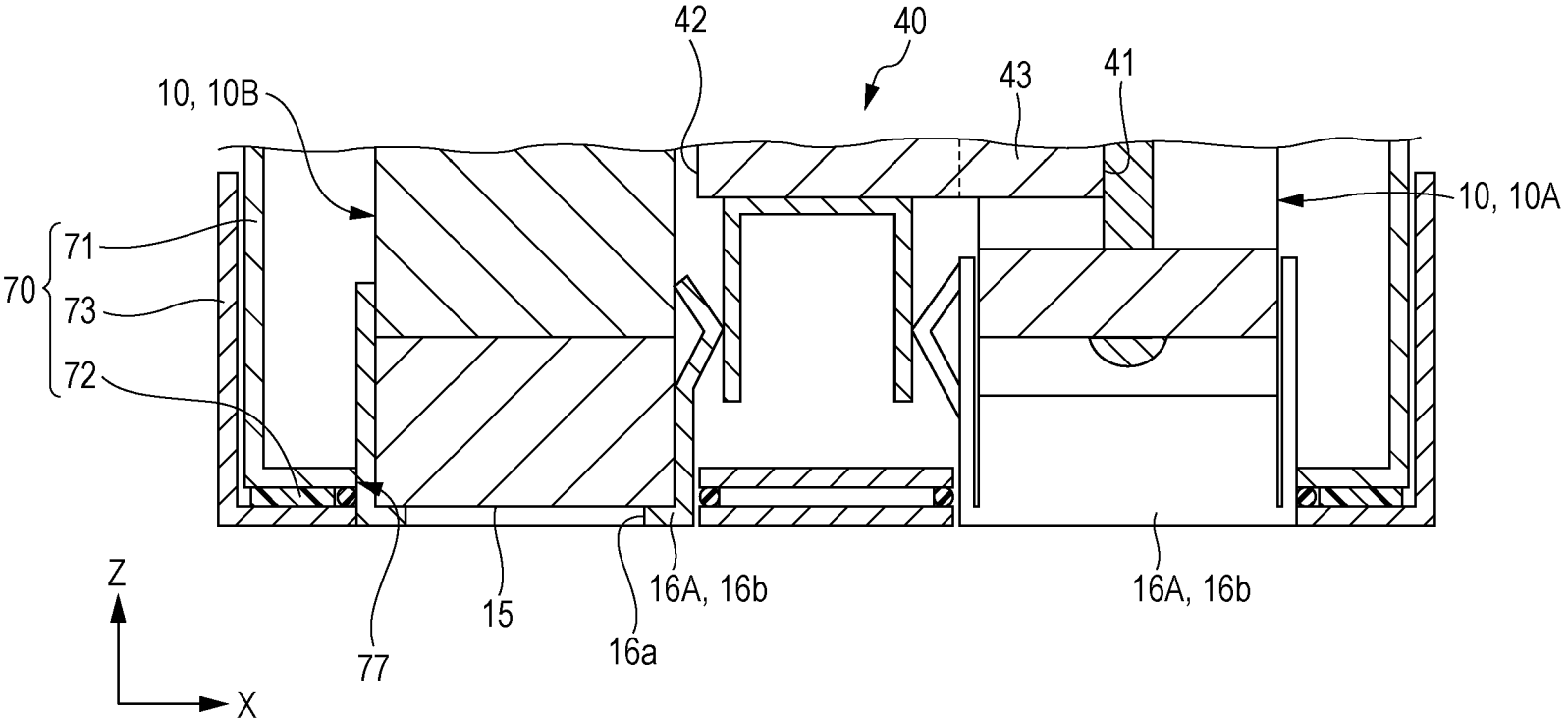
FIG. 20 is an enlarged view of the main portions in FIG. 19.
Figure 21:
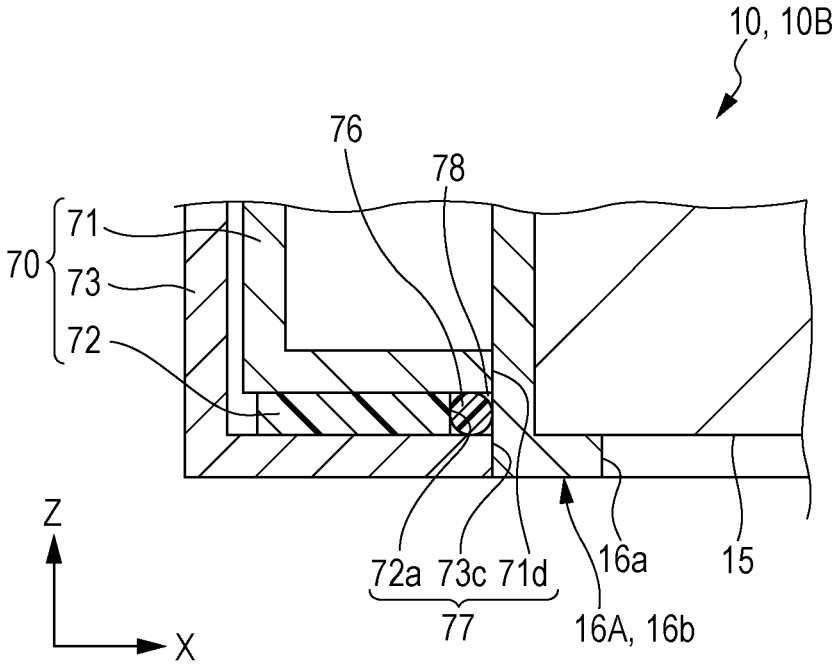
FIG. 21 is an enlarged view of the main portions in FIG. 20.

FIG. 18 is a bottom view of the head unit according to Embodiment 2, FIG. 19 is a cross-sectional view taken along the line XIX-XIX in FIG. 18, FIG. 20 is an enlarged view of the main portions in FIG. 19, and FIG. 21 is an enlarged view of the main portions in FIG. 20.

As shown the drawings, the head unit 1A according to the embodiment includes a head 10 on which a cover head 16A that covers the nozzle surface 15 is provided, a holding member 30 to which a plurality of the heads 10 is attached, a cover 70 that covers between the nozzle surfaces 15, and a grounding plate 80 provided on the holding member 30 and establishing conduction by contacting the cover head 16A.

Figure 22:
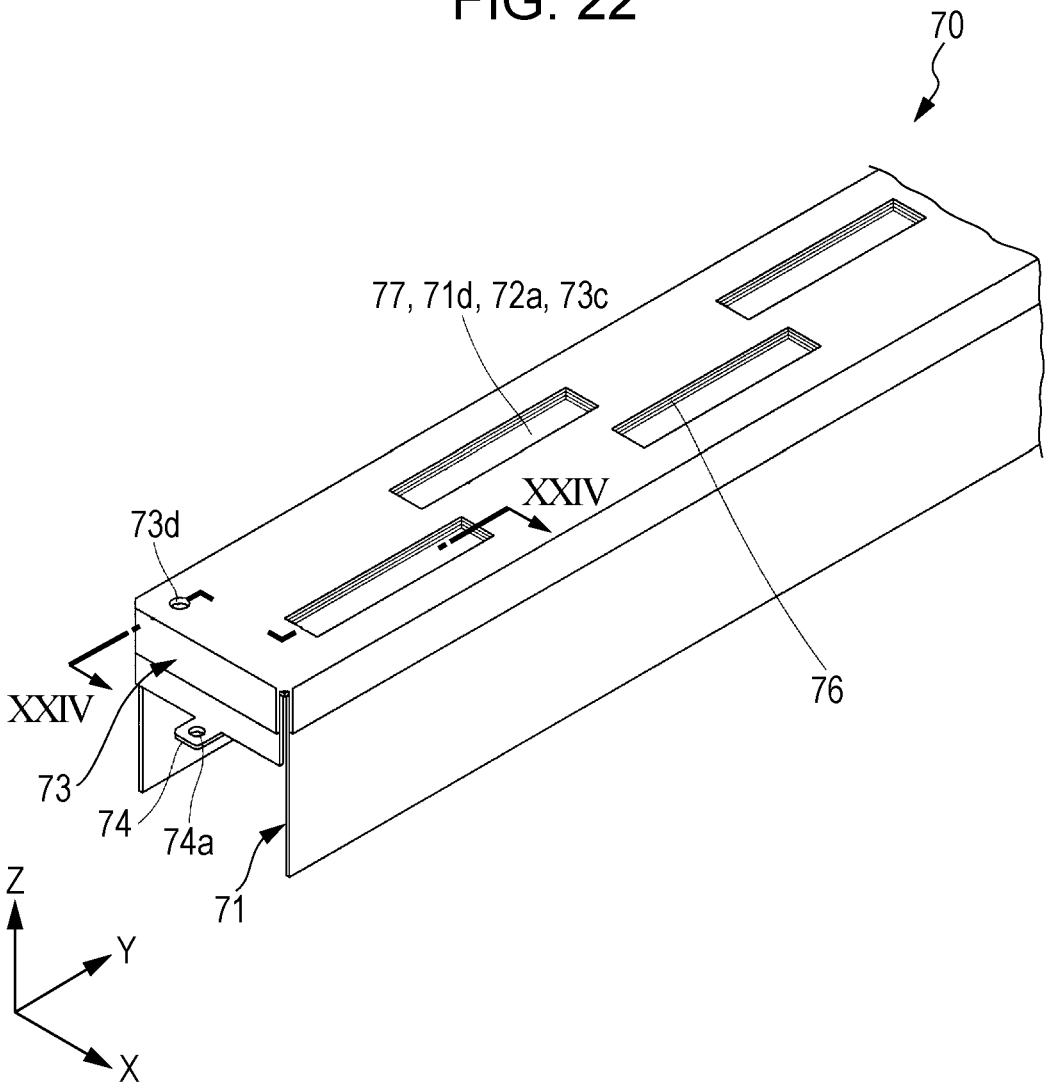
FIG. 22 is a perspective view of a cover according to Embodiment 2.

First, the cover 70 will be described using FIGS. 22 to 24. FIG. 22 is a perspective view of a cover according to Embodiment 2, FIG. 23 is an exploded perspective view of the cover according to Embodiment 2, and FIG. 24 is a cross-sectional view taken along line XXIV-XXIV in FIG. 22.

Figure 23:
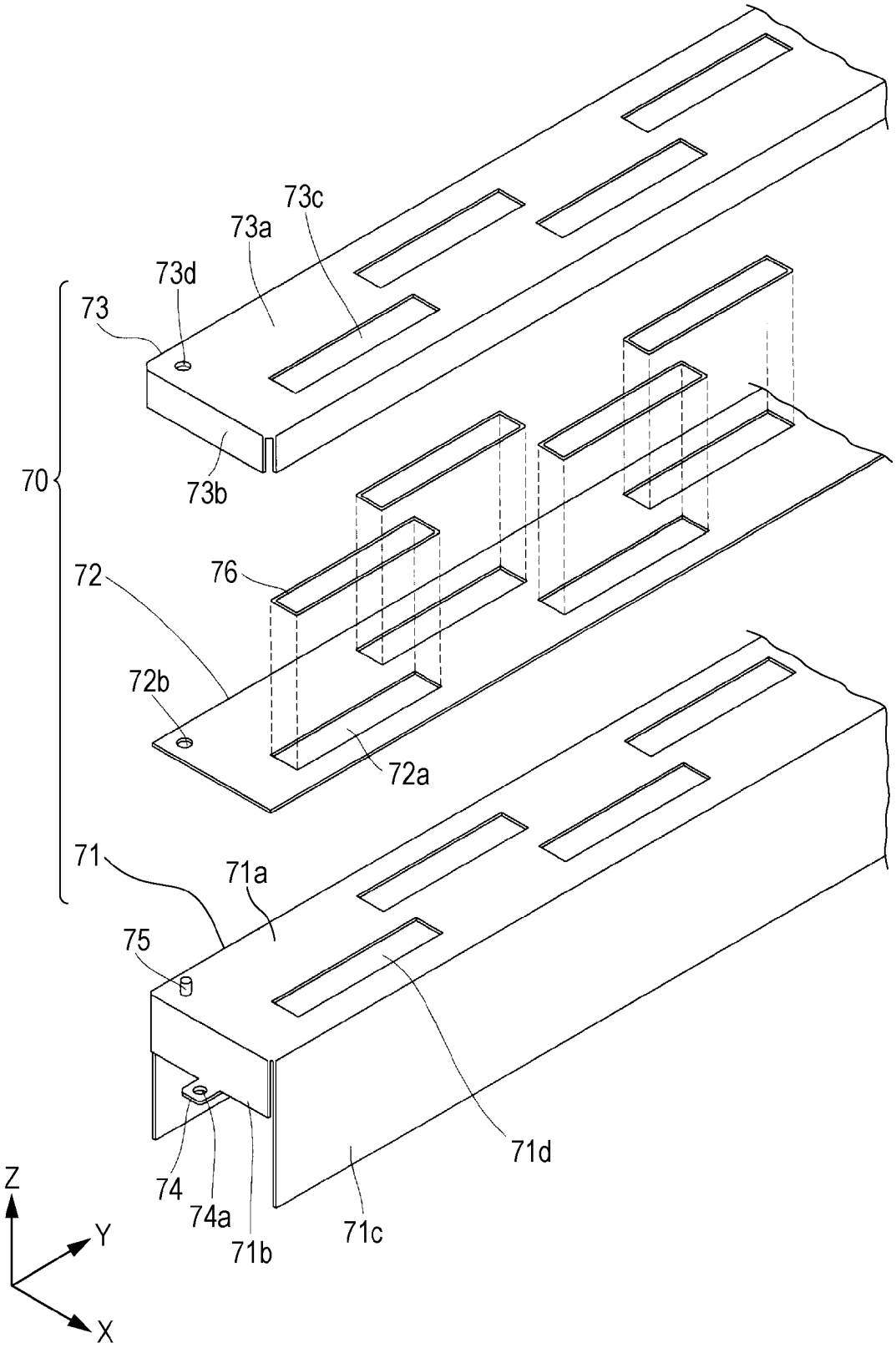
FIG. 23 is an exploded perspective view of the cover according to Embodiment 2.
Figure 24:
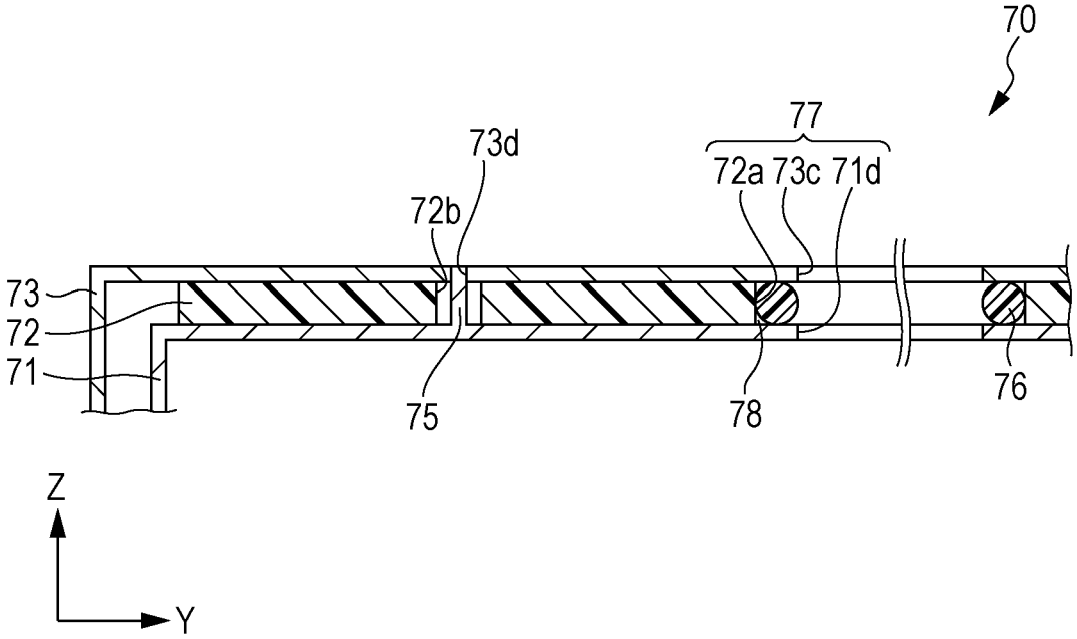
FIG. 24 is a cross-sectional view taken along line XXIV-XXIV in FIG. 22.

As shown in FIGS. 22 and 23, the cover 70 is a member that covers outside the nozzle surfaces 15 and between each nozzle surface 15, along with exposing the nozzle surface 15 of each head 10. More specifically, the cover 70 includes a first groove forming member 71, a second groove forming member 72, and an outside member 73.

The first groove forming member 71 includes a planar portion 71*a* that covers between the nozzle surfaces 15 of each head 10, and side surface portion 71*b* and side surface portion 71*c* bent to the head 10 side and continuous with the planar portion 71*a*. The side surface portion 71*b* has a side surface parallel to the XZ plane and has a fixing portion 74 fixed to the holding member 30. The side surface portion 71*c* has a side surface parallel to the YZ plane, and is formed to cover the side surface of each head 10.

In the planar portion 71*a*, an opening portion 71*d* by which the nozzle surface 15 is exposed is provided in a region that opposes the nozzle surface 15 of each head 10, and further, a conducting pin 75 protruded to the second groove forming member 72 side described later is provided on the surface of the planar portion 71*a*. The fixing portion 74 is a planar site continuous with the side surface portion 71*b* and substantially parallel to the XY plane, and includes a fixing hole 74*a* that penetrates in the Z direction.

The material of such a first groove forming member 71 is not particularly limited if the material is able to conduct. The first groove forming member 71 according to the embodiment, for example, is a planar member formed from a metal, the planar portion 71*a*, side surface portion 71*b* and side surface portion 71*c* are formed by folding back the four sides thereof to one surface side, and the opening portion 71*d* is formed by removing a portion of the planar portion 71*a*.

The second groove forming member 72 is a plate-like member interposed between the first groove forming member 71 and the outside member 73. The second groove forming member 72 has the same or a smaller planar shape as the planar portion 71*a* of the first groove forming member 71.

In the second groove forming member 72, an opening portion 72*a* that exposes the nozzle surface 15 is provided in a region that opposes the nozzle surface 15 of each head 10. Although described in detail later, each opening portion 72*a* is an opening by which the nozzle surface 15 is exposed by communicating with each opening portion 71*d* of the first groove forming member 71. Furthermore, in the second groove forming member 72, a through hole 72*b* penetrating in the Z direction and into which the conducting pin 75 is inserted is formed.

The material of such a second groove forming member 72 is not particularly limited, and may be a material that is able to conduct, or may be an insulating material. The second groove forming member 72 according to the embodiment, for example, is a planar member formed from an insulating resin material, and the opening portion 72*a* is formed by removing the region opposing the nozzle surface 15.

The outside member 73 includes the planar portion 73*a* that covers between the nozzle surfaces 15 of each head 10, and the side surface portion 73*b* continuous with the planar portion 73*a* that is bent to the head 10 side. That is, the outside member 73 surrounds the planar portion 73*a* and the side surface portion 73*b*, is opened to the head 10 side, and has a box shape in which the planar portion 73*a* becomes the bottom portion.

In the planar portion 73*a*, an opening portion 73*c* that exposes the nozzle surface 15 is provided in a region that opposes the nozzle surface 15 of each head 10, and further, a conducting hole 73*d* that is a through hole in which the conducting pin 75 is inserted is provided in the planar portion 73*a*.

The material of such an outside member 73 is not particularly limited if the material is able to conduct. The outside member 73 according to the embodiment, for example, is a planar member formed from a metal, the planar portion 73*a*, and the side surface portion 73*b* are formed by folding back the four sides thereof to one surface side, and the opening portion 73*c* and the conducting hole 73*d* are formed by removing a portion of the planar portion 73*a*.

As shown in FIG. 24, the second groove forming member 72 is bonded to one surface of the planar portion 71*a* of the first groove forming member 71, that is, to the surface on the opposite side in the Z direction to the side surface portion 71*c*. Furthermore, the outside member 73 is attached to the first groove forming member 71 such that the second groove forming member 72 is interposed between the outside member 73 and the first groove forming member 71. The form of bonding is not particularly limited, and, for example, the first groove forming member 71, the second groove forming member 72, and the outside member 73 may be bonded to one another with an adhesive, or may be bonded and fixed using a fastening tool, such as a screw.

Thereby, a head opening 77 in which each opening portion 71*d*, opening portion 72*a*, and opening portion 73*c* are communicated is formed by layering and integrating the planar portion 71*a* of the first groove forming member 71, the second groove forming member 72 and the planar portion 73*a* of the outside member 73 as the cover 70. Although described in detail below, one head 10 is inserted in the head opening 77.

More specifically, the opening portion 71*d* and the opening portion 73*c* are formed to have substantially the same shape, and the opening portion 72*a* is formed to have a larger shape than that of the opening portion 71*d* and the opening portion 73*c*. Although not specifically shown in the drawings, when the opening portion 71*d*, the opening portion 72*a* and the opening portion 73*c* communicate, the opening portion 71*d* and the opening portion 73*c* are arranged overlapping in the opening portion 72*a* in plan view (plane view from the Z direction).

A groove portion 78 is formed in the inner surface of such a head opening 77. In the embodiment, the first groove forming member 71 having the opening portion 71*d*, the opening portion 72*a* and the opening portion 73*c* with the above-described shape, the second groove forming member 72 and the outside member 73 are formed by bonding.

An elastic sealing member 76 formed from an elastic material formed in a ring shape is fitted in the groove portion 78. More specifically, the opening shape of the inner side of the elastic sealing member 76 is substantially the same shape as the opening portion 71*d* and the opening portion 73*c* in which the head 10 is inserted, and the profile of the elastic sealing member 76 is formed to be smaller than the opening portion 72*a* of the second groove forming member 72. The thickness of the elastic sealing member 76 is substantially the same as the thickness of the second groove forming member 72. The elastic sealing member 76 is formed from an insulating material having elasticity, for example, a resin material.

The elastic sealing member 76 configures a part of the inner surface of the head opening 77 so as to be interposed between the first groove forming member 71 and the outside member 73. In this way, since the elastic sealing member 76 is interposed between the first groove forming member 71 and the outside member 73, it is possible to easily fix the elastic sealing member 76. The outside member 45 serves to fix the elastic sealing member 76 as well as covering between the nozzle surfaces 15 of the head 10. Therefore, it is possible to simplify the manufacturing of the cover 70.

The conducting pin 75 provided on the first groove forming member 71 is inserted in the through hole 72*b* and fitted in the conducting hole 73*d* of the outside member 73. That is, the first groove forming member 71 contacts the outside member 73 via the conducting pin 75. In the present embodiment, although the conducting pin 75 and the outside member 73 conduct with one another by being in contact, there is no limitation to such a form. For example, examples include a form in which the side surface of the cover 70, that is, the side surface portion 71*c* of the first groove forming member 71 and the side surface portion 73*b* of the outside member 73 are brought into direct contact, and a form in which the side surface portion 71*c* and the side surface portion 73*b* are fixed with a conductive material.

By configuring the cover 70 as described above, the second groove forming member 72 is formed with an insulating material, and even if the outside member 73 is charged, although described in detail below, it is possible to discharge the charged electrical charge via the conducting pin 75 and the first groove forming member 71.

As the form in which conduction is established between the outside member 73 and the first groove forming member 71, there is no limitation to a case in which the above-described conducting pin 75 is used. For example, it is possible to adopt a form in which the second groove forming member 72 is formed with a conducting material and adhering is performed using a conductive adhesive.

A material is used that is thicker than the outside member 73 and thinner than the second groove forming member 72 for the first groove forming member 71 of the embodiment. The first groove forming member 71 and the outside member 73 are formed by such a material being bent, and the second groove forming member 72 is not bent. That is, the second groove forming member 72 that is relatively thickest of the members that configure the cover 70 is not bent, and the first groove forming member 71 and the outside member 73 that are relatively thinner than the second groove forming member 72 are bent.

Although the relationship between the thicknesses of the members that configure the cover 70 is not limited to the form described above, in this way, since the first groove forming member 71 and the outside member 73 are relatively thin, forming the members by bending is easily performed. Because the thickest second groove forming member 72 has a planar shape that is not bent, the width in the transport direction (X direction) may be reduced. If the second groove forming member 72 is bent and a side surface portion that corresponds to the side surface portion 71*c* of the first groove forming member 71 is formed, the thick portion and the width in the X direction of the side surface portion is lengthened.

Although the outside member 73 that is furthest to the outside is formed to be relatively thinnest, since the first groove forming member 71 and the second groove forming member 72 are bonded, the rigidity of the cover 70 is improved overall.

The cover 70 with the above-described configuration covers the head 10 in a state in which the nozzle surface 15 of each head 10 is exposed in the head opening 77 and is fixed to the holding member 30. Below, the head unit 1A with such a cover 70 attached will be described in detail using FIGS. 18 to 21.

As shown in the drawings, the first groove forming member 71 side of the cover 70 is attached to the holding member 30. More specifically, the nozzle surface 15 of each head 10 fixed to the holding member 30 is inserted in the head opening 77 of the cover 70 from the first groove forming member 71 side (opening portion 73*c* side). The side surface of the cover head 16A of each head 10 contacts the elastic sealing member 76 provided inside the head opening 77. Accordingly, the gap between the cover head 16A and the head opening 77 is sealed by the elastic sealing member 76. In so doing, it is possible to suppress the transfer of ink or mist from the exterior of the cover 70 to the interior head 10 via the gap, and to suppress shorting of the electrical components of the head 10.

The opening portion 16*a* of the cover head 16A and the surface (surface on the side opposite to the holding member 30 in the Z direction) of the frame portion 16*b* are substantially flush with the surface of the outside member 73 of the cover 70.

Although not shown in the drawings, each nozzle surface 15, while contacting a blade-like wiping member or the like made of rubber, performs cleaning (wiping) that removes ink or foreign materials attached to the surface by relatively moving in the XY plane.

Accordingly, it is possible to clean the opening portion 16*a* of the cover head 16A, the surface of the frame portion 16*b* and the surface of the outside member 73 when cleaning simply by the head unit 1A relatively moving with respect to the wiping member in the XY plane. As described above, since the gap between the cover head 16A and the head opening 77 is sealed with the elastic sealing member 76, it is possible to suppress the infiltration of ink or mist and the like from the gap, and to suppress shorting of the electronic components of the head 10 even during cleaning.

If the surface of the outside member 73 protrudes further to the opposite side to the holding member 30 in the Z direction than the opening portion 16*a* of the cover head 16A and the surface of the frame portion 16*b*, a mechanism is necessary for moving the wiping member in the Z direction in order to contact the nozzle surface 15.

The fixing portion 74 formed on the first groove forming member 71 of the cover 70 contacts the top surface 40*a* of the holding portion 40 of the holding member 30, and is fixed with a screw 79 that is an example of a fixing member. The top surface 40*a* of the holding portion 40 referred to here is the surface of the nozzle surface 15 side in the Z direction.

The screw 79 is formed from a conductive metal material. As described above, the first groove forming member 71 conducts with the outside member 73 via the conducting pin 75. Accordingly, the entire cover 70 including the outside member 73 conducts with the holding member 30 via the screw 79.

Meanwhile, the cover 70 only contacts the head 10 by the elastic sealing member 76, and does not contact the head 10 at other sites. Since the elastic sealing member 76 is formed from an insulating material, the head 10 does not conduct through direct contact with the cover 70. That is, the cover 70 does not directly conduct with the head 10, and directly conducts with the holding member 30.

Figure 25:
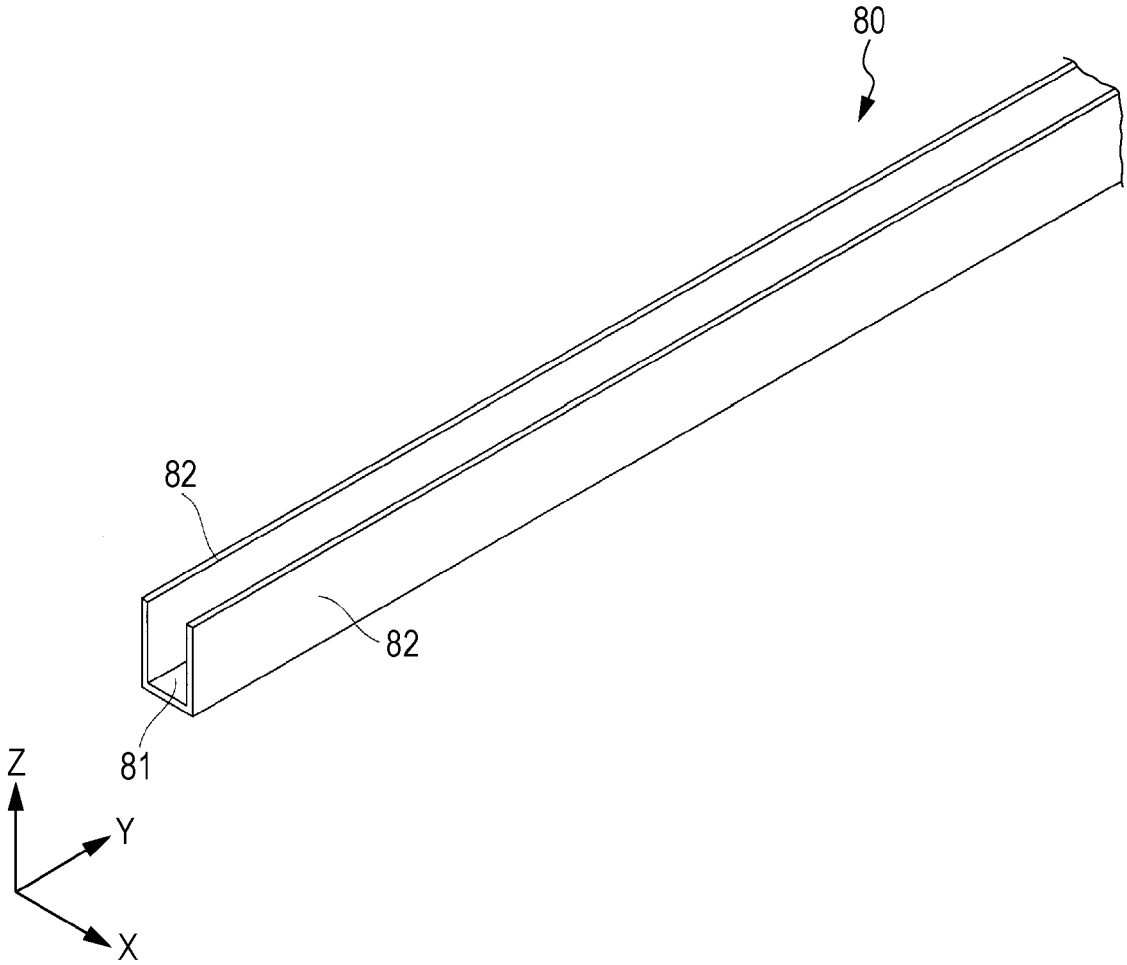
FIG. 25 is a perspective view of a grounding plate according to Embodiment 2.
Figure 26:
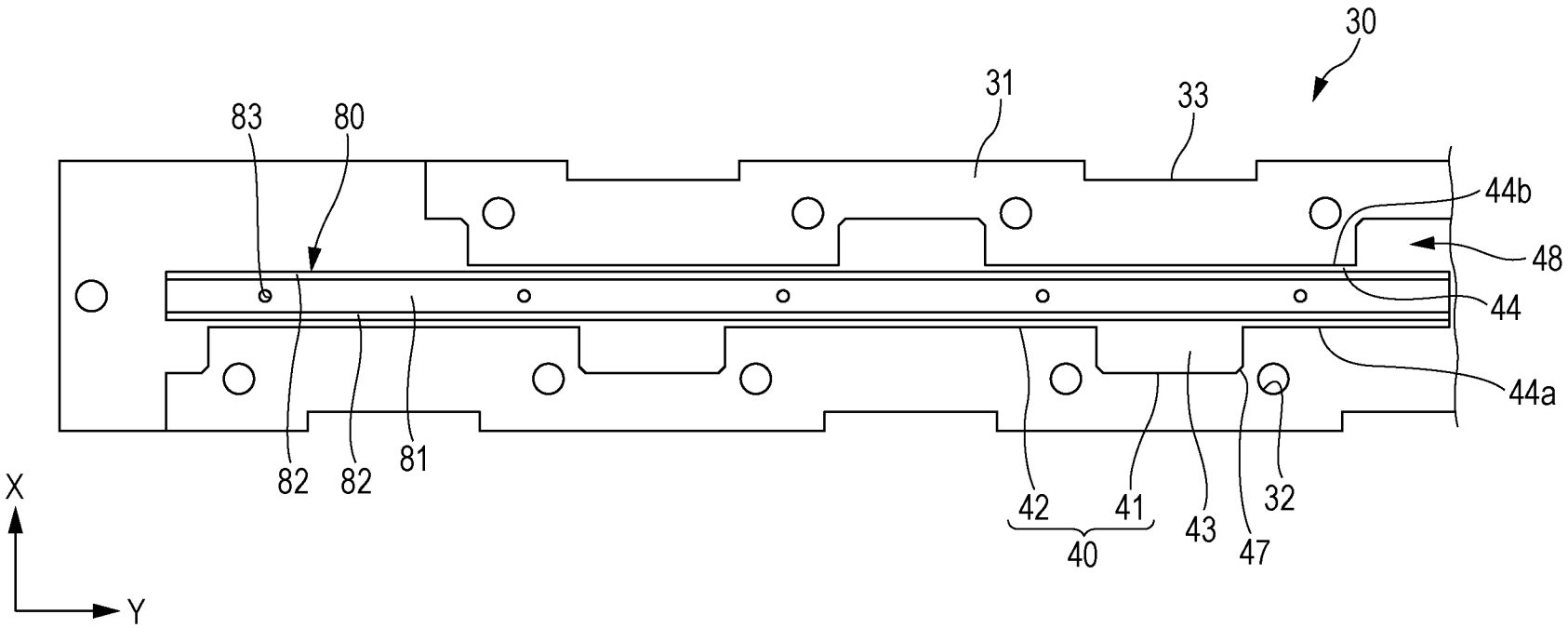
FIG. 26 is a plan view of the grounding plate provided on a holding member according to Embodiment 2.

The head 10 according to the embodiment conducts with the holding member 30 rather than the cover 70 via the grounding plate 80. Here, the grounding plate 80 will be described using FIG. 25 and FIG. 26. FIG. 25 is a perspective view of the grounding plate according to Embodiment 2, and FIG. 26 is a plan view of the grounding plate provided on the holding member according to Embodiment 2.

The grounding plate 80 is a plate spring-like member fixed to the holding member 30. More specifically, the grounding plate 80 is fixed to the top surface 40*a* of the holding portion 40 of the holding member 30, and has a plate-like attachment portion 81 long in the Y direction. An insertion hole 83 penetrating in the thickness direction is provided in the attachment portion 81. A fixing member such as a screw is inserted in the insertion hole 83.

The grounding plate 80 has two plate-like plate spring portions 82 continuous from the long side of the attachment portion 81, that is the side parallel to the Y direction, and substantially parallel to the YZ plane. The two plate spring portions 82 are biased in mutually separating directions (X direction).

The material of such a grounding plate 80 is not limited, if the material is able to conduct. The grounding plate 80 according to the embodiment, for example, is a planar member formed from a metal, a plate spring portion 82 is formed by folding back two sides thereof parallel in the Y direction to one surface side, and the insertion hole 83 is formed by removing a portion of the attachment portion 81.

Such a grounding plate 80 is fixed (refer to FIG. 19 and FIG. 26) to the holding portion 40 of the holding member 30 so that the plate spring portion 82 between the two rows, head row 10A and head row 10B, becomes parallel. The fixing unit of the grounding plate 80 is not particularly limited. In the embodiment, a screw hole (not shown) is provided in the top surface 40*a* of the holding portion 40 of the holding member 30, and the grounding plate 80 is fixed to the holding member 30 by a screw (not shown) being inserted in the insertion hole 83 and screwed into the screw hole.

As shown in FIG. 19 and FIG. 20, the cover head 16A attached to each head 10 includes a bent portion 16*c* that is bent such that a portion of the side surface facing the holding portion 40 side of the holding member 30 protrudes to the holding portion 40 side. The plate spring portion 82 of the grounding plate 80 described above contacts the bent portion 16*c* side by being biased.

In this way, the grounding plate 80 is directly fixed to the holding member, and also directly contacts the cover head 16A. In Embodiment 1, the cover head 16A contacts the peripheral edge portion of the nozzle surface 15 as described. Accordingly, for the head 10, conduction from the nozzle surface 15 to the holding member 30 is established via the cover head 16A and the grounding plate 80.

Although the surface of the cover head 16A is treated for water repellency in order to suppress the attachment of liquids such as ink, water repellency treatment is not performed on the bent portion 16*c* that the plate spring portion 82 of the grounding plate 80 contacts. In so doing, it is possible to establish favorable conduction through the grounding plate 80 along with suppressing the attachment of liquids such as ink to the cover head 16A.

As described above, according to the head unit 1A according to the embodiment, an elastic sealing member 76 is provided between the head opening 77 of the cover 70 and the cover head 16A of the head 10. In so doing, it is possible to suppress the infiltration of ink, mist or the like to the head 10 from the exterior of the cover 70 via the gap between the head opening 77 and the cover head 16A. Electrically, the head 10 conducts with the holding member 30 via the grounding plate 80, and the cover 70 conducts with the holding member 30. That is, even if the head 10 and the cover 70 do not directly conduct with one another, the head 10 and the cover 70 conduct with a common holding member 30. In so doing, it is possible to suppress charging in the head 10 and the cover 70 by grounding the holding member 30.

Although the conducting portion referred to in the aspect is a portion that electrically conducts with the cover head 16A (protective plate) of the head 10, in the present embodiment, the fixing portion 74 that contacts the holding member 30 of the cover 70 corresponds thereto. That is, the fixing portion 74 as the conducting portion indirectly electrically conducts with the cover head 16A of the head 10 via the holding member 30 and the grounding plate 80.

For the cover 70 according to the embodiment, the elastic sealing member 76 is interposed between the first groove forming member 71 and the outside member 73, and is fixed in this state to the holding member 30 by a screw 79. Therefore, even if the elastic sealing member 76 elastically deforms and a counterforce is applied in a direction in which the cover head 16A separates from the grounding plate 80, since the cover 70 is fixed to the holding member 30 by the screw 79 that is a fixing member, the sealing function due to the elastic sealing member 76 is maintained. Furthermore, the screw 79 serves a function of establishing conduction between the cover 70 and the holding member 30 along with fixing the cover 70 to the holding member 30. Therefore, it is possible to achieve cost reductions by reducing the number of components.

In the embodiment, although the elastic sealing member 76 is provided between the cover head 16A and the head opening 77 of the cover 70, there is no limit thereto. For example, a conductive elastic sealing member may be used, or an adhesive may be used.

Embodiment 3

Figure 27:
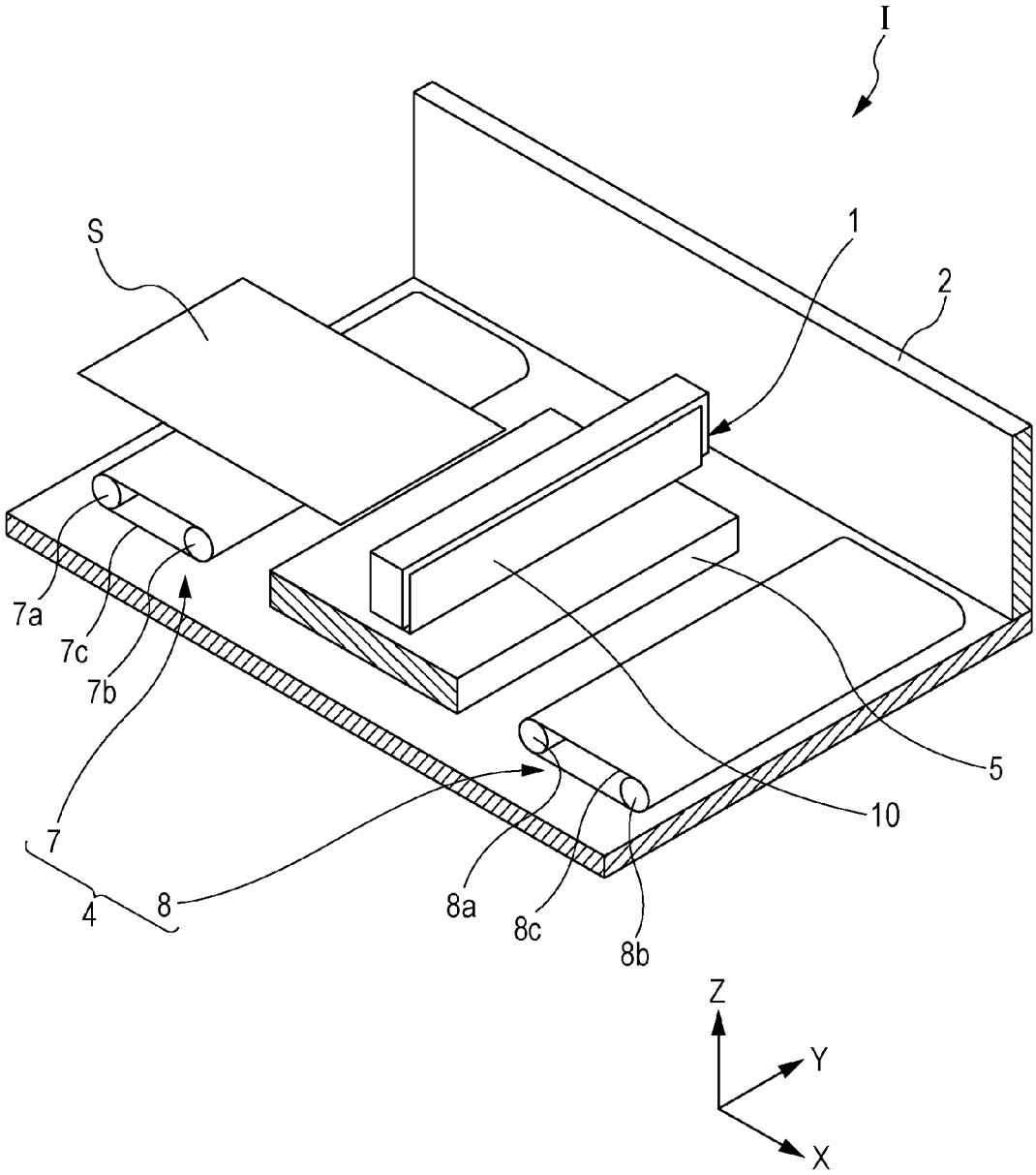
FIG. 27 is a schematic perspective view of a recording apparatus according to Embodiment 3.

An ink jet recording apparatus that is an example of a liquid ejecting apparatus including the head unit 1 according to Embodiment 1 will be described. FIG. 27 is a schematic perspective view of the ink jet recording apparatus according to the embodiment. Moreover, like elements to Embodiment 1 are given like references, and overlapping description will not be made.

The ink jet recording apparatus I is a so-called line-type recording apparatus in which the head unit 1 is fixed, and performs printing by transporting the ejection medium such as a recording sheet. More specifically, the ink jet recording apparatus I includes a head unit 1, an apparatus main body 2 and a transport unit 4 that transports the ejection medium S.

The head unit 1 is attached to the apparatus main body 2 so that the ejection medium S is transported in a transport direction (X direction) orthogonal to the parallel direction (Y direction) of the nozzle row 14. As described in Embodiment 1, the head unit 1 includes heads 10 arranged in a zig-zag pattern along the Y direction, and a nozzle row unit. In so doing, it is possible to perform printing in all regions across the Y direction that intersects the transport direction of the ejection medium S.

Although not shown in the drawings, a flow channel forming member is provided on the upper surface side of the head unit 1. Ink is supplied from an ink storage unit, such as an ink tank or ink cartridge in which ink is stored, and the flow channel forming member supplies ink to each head 10 via the connection flow channel 32 of the holding member 30. The ink storage unit may be provided integrated with the flow channel forming member, or may be held at a different position in the apparatus main body 2 from the head unit 1.

The transport unit 4 includes, for example, a first transport unit 7 and a second transport unit 8 provided at both sides in the X direction of the head unit 1.

The first transport unit 7 is configured with a driving roller 7*a*, a driven roller 7*b* and a transport belt 7*c* wound around the driving roller 7*a* and the driven roller 7*b*. The second transport unit 8 is configured with a driving roller 8*a*, a driven roller 8*b* and a transport belt 8*c* similarly to the first transport unit 7.

A driving unit, such as a driving motor not shown in the drawings, is connected to the respective driving rollers 7*a* and 8*a* of the first transport unit 7 and the second transport unit 8, and the ejection medium S is transported to the upstream and downstream sides of the head unit 1 by the transport belts 7*c* and 8*c* being driven to rotate by the driving force of the driving unit.

According to such an ink jet recording apparatus I, printing is performed by ink being ejected from each head 10 of the head unit 1 and the ink landing on the ejection medium S while the ejection medium S is transported.

In the above-described example, although the head unit 1 is fixed to the apparatus main body 2, and the transport unit 4 transports the ejection medium S, there is no limitation to such a form. Because the transport unit 4 causes the head unit 1 and the ejection medium S to relatively move, the ejection medium S may be fixed and the transport unit 4 may transport the head unit 1. The ink jet recording apparatus I not only includes a case of including one head unit 1, but may also include a plurality of head units 1. Furthermore, it is also possible for the head unit 1A according to Embodiment 2 to be mounted in the ink jet recording apparatus I similarly to the head unit 1.

Other Embodiments

Above, the embodiments of the invention have been described, but the basic configuration of the invention is not limited to the above. The modification example below may be used alone or a plurality may be combined with the above-described embodiments or a combination thereof.

For example, although one conducting portion 66 provided in the cover 60 may be formed for each head 10, there is no limitation to such a form. A configuration may be used in which conduction is established by a plurality of heads 10 contacting one conducting portion 66.

The cover 60 is not necessarily attachable and detachable from the head unit 1, and may be fixed with a screw or the like.

Furthermore, the invention may be widely applied to liquid ejecting apparatuses, and may also be applied to liquid ejecting apparatuses that include recording heads such as various ink jet recording heads that are used in an image recording apparatus, such as a printer, color material ejecting heads used to manufacture color filters for liquid crystal displays or the like, electrode material ejecting heads used to form electrodes, such as for organic EL displays and field emission displays (FED), and biological organic substance ejecting heads used to manufacture bio chips, and the like.

What is claimed is:

1. A liquid ejecting head unit comprising:

a plurality of liquid ejecting heads including a liquid ejecting surface in which nozzle openings that eject a liquid are provided;

a protective plate that protects the liquid ejecting surface of each liquid ejecting head;

a cover that covers between the liquid ejecting surfaces of each liquid ejecting head, wherein the cover has a conducting portion that electrically conducts with the protective plate of the liquid ejecting head;

a holding member to which the plurality of liquid ejecting heads is fixed, wherein the plurality of liquid ejecting heads are grounded to the cover via the holding member;

an elastic sealing member that seals between the protective plate and the cover; and a fixing member that fixes the cover and the holding member to be able to conduct with each other;

wherein the cover includes and outside member, a first groove forming member, and a second groove forming member between the outside member and the first groove forming member, wherein a head opening by which the liquid ejecting surface of the liquid ejecting head is exposed is provided in the outside member, the first groove forming member and the second groove forming member, wherein the outside member conducts with the first groove forming member, wherein the fixing member fixes the first groove forming member and the holding member to be able to conduct with each other, and wherein the elastic sealing member is arranged at the groove portion in which the inner surface of the head opening is provided, and is interposed between the outside member and the first groove forming member.

2. The liquid ejecting head unit according to claim 1 further comprising:

a plate spring-like grounding plate fixed to the holding member, wherein the grounding plate contacts the protective plate by being biased, and conducts with the protective plate and the holding member.

3. A liquid ejecting apparatus comprising the liquid ejecting head unit according to claim 2.

4. The liquid ejecting head unit according to claim 1, wherein the first groove member is formed to be thicker than the outside member and thinner than the second groove forming member, the outside member and the first groove forming member each have a curved side surface portion, and the second groove forming member is formed in a planar shape.

5. A liquid ejecting apparatus comprising the liquid ejecting head unit according to claim 4.

6. The liquid ejecting head unit according to claim 1, wherein the cover is attachable and detachable, and the conducting portion abuts on the protective plate by elastic deformation.

7. A liquid ejecting apparatus comprising the liquid ejecting head unit according to claim 6.

8. The liquid ejecting head unit according to claim 1, wherein a protrusion is provided at a position opposing a region abutted by the conducting portion of the cover on the liquid ejecting head or the protective plate.

9. A liquid ejecting apparatus comprising the liquid ejecting head unit according to claim 8.

10. A liquid ejecting apparatus comprising the liquid ejecting head unit according to claim 1.

* * * * *